US007914230B2

(12) United States Patent
Moore, Jr. et al.

(10) Patent No.: US 7,914,230 B2
(45) Date of Patent: Mar. 29, 2011

(54) CORRUGATED LEACHING CHAMBER WITH HOLLOW PILLAR SUPPORTS

(75) Inventors: Roy E. Moore, Jr., Killingworth, CT (US); Bryan A. Coppes, Old Saybrook, CT (US); Dennis F. Hallahan, Old Lyme, CT (US); Christopher R. Cardillo, Berlin, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 12/823,896

(22) Filed: Jun. 25, 2010

(65) Prior Publication Data

US 2010/0329787 A1 Dec. 30, 2010

Related U.S. Application Data

(60) Provisional application No. 61/269,880, filed on Jun. 29, 2009, provisional application No. 61/396,524, filed on May 28, 2010.

(51) Int. Cl.
*E02B 11/00* (2006.01)

(52) U.S. Cl. ..... 405/46; 405/49

(58) Field of Classification Search ..... 405/46, 405/49, 45, 44, 43, 36
See application file for complete search history.

(56) References Cited

U.S. PATENT DOCUMENTS

| | | | | |
|---|---|---|---|---|
| 2,366,522 | A | 1/1945 | Gutman | |
| 4,697,954 | A | 10/1987 | Grund | |
| 5,087,151 | A | 2/1992 | DiTullio | |
| 5,456,379 | A | 10/1995 | Krupa et al. | |
| 5,511,903 | A | 4/1996 | Nichols et al. | |
| 5,890,838 | A | 4/1999 | Moore et al. | |
| 5,916,104 | A | 6/1999 | Lucenet et al. | |
| 6,129,482 | A | 10/2000 | Ditullio | |
| 6,361,248 | B1 | 3/2002 | Maestro | |
| D462,901 | S | 9/2002 | Giard et al. | |
| 6,443,652 | B1 | 9/2002 | Houck et al. | |
| 6,649,060 | B2 | 11/2003 | Perry | |
| D514,452 | S | 2/2006 | Enriquez | |
| 7,306,399 | B1 | 12/2007 | Smith | |
| 7,351,006 | B2 * | 4/2008 | Burnes et al. | 405/46 |
| 7,419,332 | B1 | 9/2008 | Brochu et al. | |

(Continued)

FOREIGN PATENT DOCUMENTS

WO 2011002500 A1 1/2011

OTHER PUBLICATIONS

Beaver et al., "Structural design of stormwater chambers," Transportation Research Board (2003) 22 pg.

(Continued)

*Primary Examiner* — Frederick L Lagman
(74) *Attorney, Agent, or Firm* — C. Nessler

(57) ABSTRACT

A plastic leaching chamber has an arch shape cross section, corrugations, and one or more hollow pillars extending downwardly within the interior of the chamber, to support the top of the chamber when the chamber is under load during use. Chambers nest within one another to form a stack of chambers for transport or storage. Chambers have peak corrugations which are substantially wider than the intervening valley corrugations. Chambers having different widths and profiles have common size connectors.

20 Claims, 15 Drawing Sheets

U.S. PATENT DOCUMENTS

| | | | |
|---|---|---|---|
| 7,465,122 | B2 | 12/2008 | Brochu et al. |
| 7,473,053 | B1 | 1/2009 | Brochu et al. |
| 7,500,805 | B1 | 3/2009 | Brochu et al. |
| D592,076 | S | 5/2009 | Sipe et al. |
| D592,077 | S | 5/2009 | Sipe et al. |
| 7,611,306 | B1 | 11/2009 | Hallahan et al. |
| 2003/0219310 | A1 | 11/2003 | Burnes et al. |
| 2004/0011786 | A1 | 1/2004 | Wade |
| 2005/0111915 | A1 | 5/2005 | Moore et al. |
| 2005/0189256 | A1 | 9/2005 | St-Onge |
| 2006/0034662 | A1 | 2/2006 | Burkhart |
| 2007/0154261 | A1 | 7/2007 | Brochu et al. |
| 2008/0128339 | A1 | 6/2008 | Burcham |
| 2008/0240859 | A1 | 10/2008 | Sipaila |
| 2010/0329788 | A1 | 12/2010 | Moore, Jr. |
| 2010/0329789 | A1 | 12/2010 | Coppes et al. |

OTHER PUBLICATIONS

International Association of Plumbing and Mechanical Officials, "Material and Property Standard for Plastic Leaching Chambers," IAPMO PS 63/2005 (2005); 4 pg.

"Infiltrator® septic tanks, TW-Series Tanks" product sheet (2009) 1 pg.

International Search Report and Written Opinion of the International Searching Authority, counterpart application No. PCT/US2010/001853 (Sep. 1, 2010).

Infiltrator Systems, Inc, "Request for Approval, Washington Department of Health Wastewater Management Program" (no date ascribed).

"How log profile chamber helps save time and labor," web page with press release, Advanced Drainage Systems, Inc., Oct. 22, 2010, 2 pages.

* cited by examiner

CORRUGATED LEACHING CHAMBER WITH HOLLOW PILLAR SUPPORTS

CROSS-REFERENCE TO RELATED APPLICATIONS

This application claims the benefit under 35 U.S.C. §119(e) of U.S. provisional application No. 61/396,524, filed May 28, 2010, and U.S. provisional application No. 61/269,880, filed Jun. 29, 2009, the disclosures of which are incorporated herein by reference in their entireties.

TECHNICAL FIELD

The present invention relates to apparatus for collecting, receiving, detaining or dispersing liquids when buried, in particular, to leaching chambers for receiving and dispersing wastewater.

BACKGROUND

As described in a number of patents and other publications, a familiar commercial leaching chamber is made of injection molded thermoplastic, has an arch shape cross section, an open bottom, a multiplicity of corrugations, and perforated sidewalls. Such chambers are buried in soil to receive wastewater, typically from a septic tank. An exemplary current commercial chamber is an Infiltrator® Quick4® chamber sold by Infiltrator Systems, Inc., Old Saybrook, Conn. A typical chamber has a width of a little less than 3 feet, a length of about 4 feet and a height in the range of 12 to 18 inches, which heights usually characterize what is called standard size and high capacity size. Chambers in a variety of other sizes have been sold by Infiltrator Systems and under other brand names in the past.

Generally, leaching chambers store substantial quantities of water within their concave interiors and provide leaching area for dispersal of water by means of the chamber open bottom and perforations in the sidewalls. Early leaching chambers had planar sides and a generally trapezoidal arch cross section as shown in U.S. Pat. Nos. 4,759,661 and 5,511,903, both of Nichols et al. More recent chambers have had continuous curve arch cross sections, as shown in U.S. Pat. No. 7,189,027 of Brochu et al.

Chambers must have sufficient strength to support overlying soil and other loads, such as motor vehicles which traverse the soil surface. Generally, chambers have obtained the requisite strength from a combination of wall thickness, arch shape cross section, corrugations, and ribs. There is a continuing aim to make more efficient use of plastic material comprising a chamber, that is, to reduce the weight of a chamber per unit length or to increase the leaching area per unit weight of plastic, while still meeting the other chamber performance objectives.

One of those performance objectives is to allow a chamber to nest on top of a like chamber with a stack height within an acceptable range. Stack heights that are too high make the storage and transport of a stack of nested chambers less efficient because fewer chambers can be stacked within a given volume. Similarly, the ability to easily remove or de-nest a chamber from the chamber beneath it in a stack of like chambers is important for ease of handling in the field.

The height of the chamber is also referred to as the profile of the chamber. An aim for certain applications is to have a chamber profile which is lower than the above-mentioned 12 inch height. A lower chamber profile can require a shallower trench in the soil, which is desirable when the bottom of the trench needs to be a certain elevation above any underlying high water table or bedrock. However, chambers having both a low profile and the well-defined arch curve characteristic of larger chambers can have unacceptably small interior storage volume. Use of extensive ribbing can adversely affect stack height of nested chambers and thus increase shipping costs.

Molded plastic stormwater chambers are chambers which are intended for receiving rain water, typically that which flows from gutters or paved parking areas. While stormwater chambers tend to be much larger and to have fewer (or no) sidewall perforations compared to leaching chambers, there is a certain degree of interchangeability in use amongst the two kinds of chambers. Of course, the weakening effect of a multiplicity of perforations, typically slots, which characterize the sidewalls of leaching chambers, has to be taken into account in design and use. Chambers used for stormwater and wastewater have been prevalently made by thermoforming of plastic sheet or by injection molding, as those processes are suited to large scale mass production.

Thus it is desirable to make the foregoing kinds of chambers which are improved and to enable a reduction in the already-low amount of plastic comprising a chamber, while at the same time providing requisite strength, good storage volume, good leaching area function and other desired properties.

SUMMARY

An object of the invention is to provide a light weight molded plastic chamber for receiving and dispersing wastewater or stormwater, or for draining soils, where the chamber has good strength, good leaching area per unit length, and good storage volume per unit length, while at the same time efficiently using plastic material. A further object is to provide a leaching chamber which has a low profile along with the foregoing features. A still further object is to provide means for interconnecting chambers of different sizes.

In accord with the invention, chambers have an arch shaped or concave-down cross section which defines an interior concavity or space, an open bottom, and opposing sidewalls which run upwardly from the base flanges to support a top. The opposing sidewalls and top are sometimes referred to as a unit, namely, as the wall of the chamber. In certain embodiments of the invention, a multiplicity of corrugations comprised of alternating peak and valley corrugations may run transverse to the chamber length.

In certain embodiments of the invention, one or more hollow pillars are attached to and support the top of the chamber during use; alternatively stated, the pillars are attached to and support the chamber wall. The pillars may provide the chamber wall with additional strength to support the overlying soil or other loads, particularly where the chamber is of a low profile design. The pillars extend downwardly within the concave interior of the chamber; and, the pillars have bases which in proximity to the plane associated with the base flanges. During use, the base of a pillar rests on the soil that underlies the chamber. The base of each hollow pillar may comprise a flat plate or it may be contoured; the base may have a through-hole.

In embodiments of the invention, a pillar wall has a tapered columnar shape; the wider upper end is open and is attached to the top or wall of the chamber. Alternatively stated, there is a hole in the chamber wall and the pillar wall is integrally attached to the periphery of the hole. When the chamber is buried in soil, soil may fill the hollow interior of the pillar. According to where it is positioned within a corrugated chamber, the open upper end of a pillar will interrupt portions of one or more of a peak and/or valley corrugation. In some embodiments, the pillars will have opposing side contours that generally align with interrupted peak or valley corrugations, to provide increased strength. In another embodiment, a pillar has sponsons, that is, downward running ridges that do not present as continuations of any corrugations.

The shape of the chamber wall and open top pillar(s) enable the chambers to stack in closely nested fashion, for economic shipment. To better enable removal of a first chamber from the top of a stack of nested chambers, in some chamber embodiments the pillar and the terminal ends of any interrupted peak and or valley corrugation are shaped so that an installer may manually lift one base flange of the chamber upwardly, to rotate the chamber about the opposing side base flange.

In some embodiments, one or more pillars are positioned symmetrically with respect to the ends of the chamber, along the centerline of the chamber. In other embodiments, pillars may be unsymmetrically arranged and may be offset from the centerline. Exemplary chambers may have one, two or four or other number of spaced apart pillars.

In some embodiments of the invention, the pillar bases provide between 4 and 15 percent, and up to 25 percent, of the total bearing area of the chamber, for supporting the chamber on soil; and, the masking of the underlying soil that results from the pillar bases is only a small percent of the leaching area of the chamber. Thus, the benefits which the one or more pillars provide are achieved without greatly compromising leaching area.

In some embodiments of the invention, some or all of the corrugations along the length of the chamber have unique and advantageous width configurations; the widths of the peak corrugations are much greater than the widths of the valley corrugations. In these embodiments of the invention, the width of each peak corrugation is at least 2 times; more preferably at least about 2.5 to 1; and it may be as much as 5 to 1 or more, as width is measured near the elevation of the base flange. Optionally, the corrugations of the foregoing chambers may also have unique width relationships at an elevation which is half the height of the perforated sidewall. In some embodiments, the peak corrugations are perforated, for example with a multiplicity of slots, and the valley corrugations are substantially free of perforations.

The unique corrugation width relationships enable more corrugations per unit length which increases strength, and they increase the amount of storage area and leaching area per unit length of chamber, compared to comparable chambers which have corrugations. Chambers having pillars and or the specially proportioned corrugation widths may have closed ends or open ends, with and without connectors for mating with other chambers. The corrugation width features may be used with or without pillars. The pillar features may be used in chambers without the corrugation width features.

In another aspect of the invention, when a group of chambers comprises a family which has different profiles and or different widths, each chamber in the group has a common-size end connector. Thus, a string of mixed size chambers can be created. And the number of accessories, such as end caps and couplers, which an installer has to carry in inventory, is reduced.

Exemplary chambers in accord with the invention are able to meet industry performance standards. They are strong, economically made, and economically transported and stored due to good stacking characteristics. Exemplary chambers have a combination of low profile and good strength, together with high storage volume, low plastic weight and high leaching area, all per unit length of chamber. Exemplary chambers may be made by different plastic forming means.

The foregoing and other objects, features and advantages of the present inventions will become more apparent from the following description of embodiments and accompanying drawings.

DETAILED DESCRIPTION

This application is related to U.S. provisional application No. 61/269,880, filed Jun. 29, 2009, and No. 61/396,524, filed May 28, 2010, the disclosures of which are incorporated herein by reference in their entireties.

Figure 1:
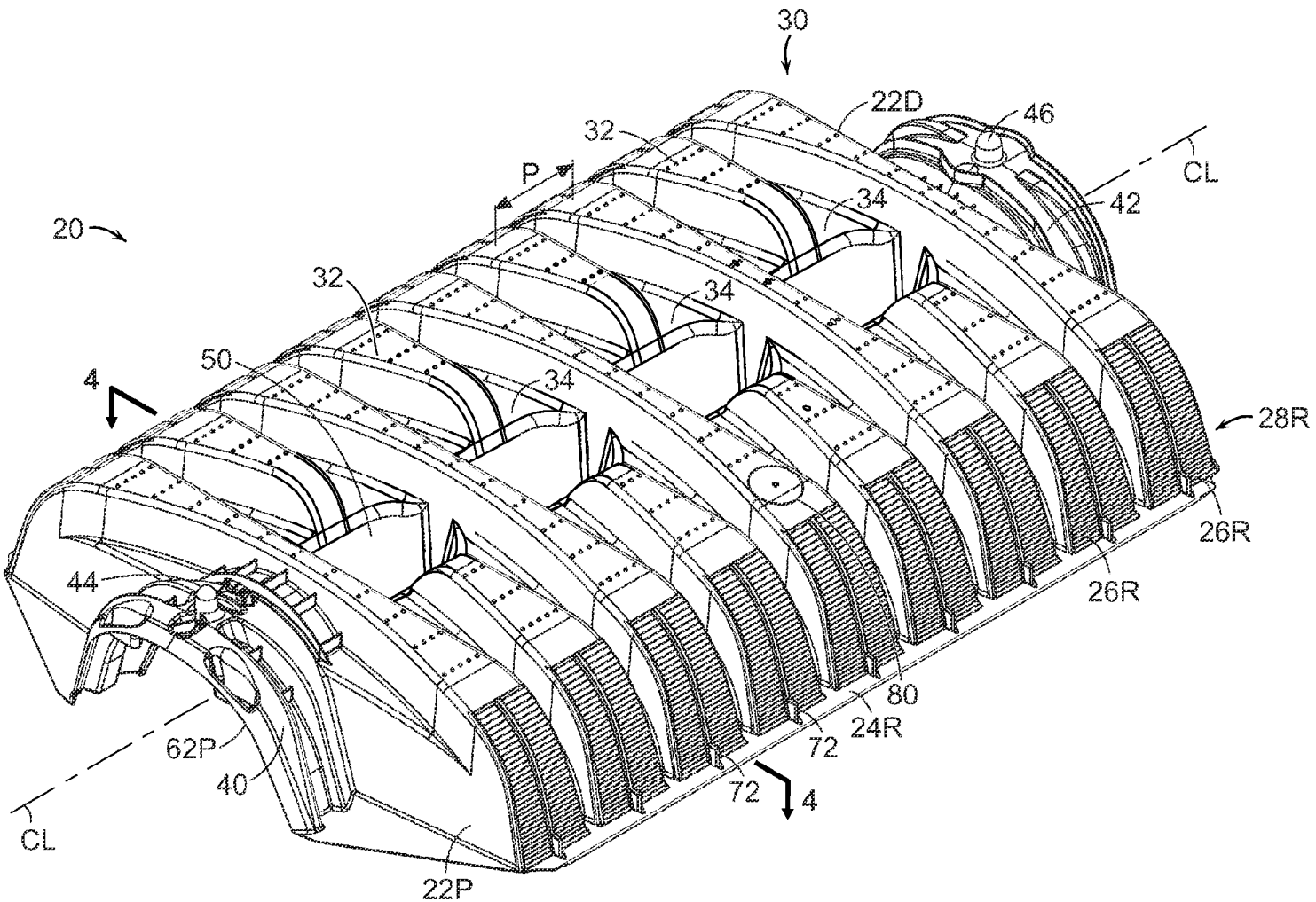
FIG. 1 is an oblique top view showing the exterior of a chamber having four centerline pillars.
Figure 2A:
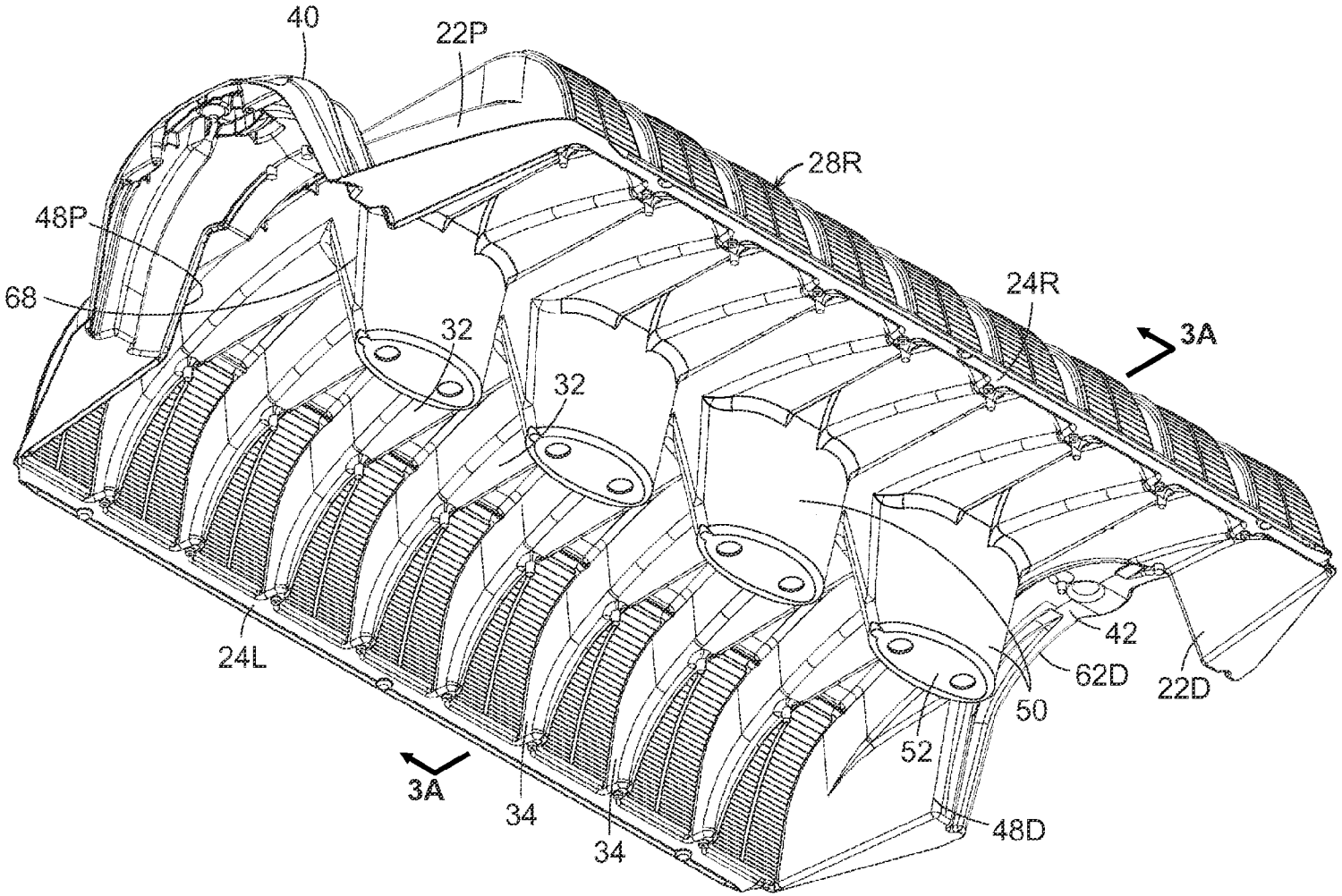
FIG. 2A is an oblique view showing the bottom and interior of the FIG. 1 chamber.
Figure 3A:
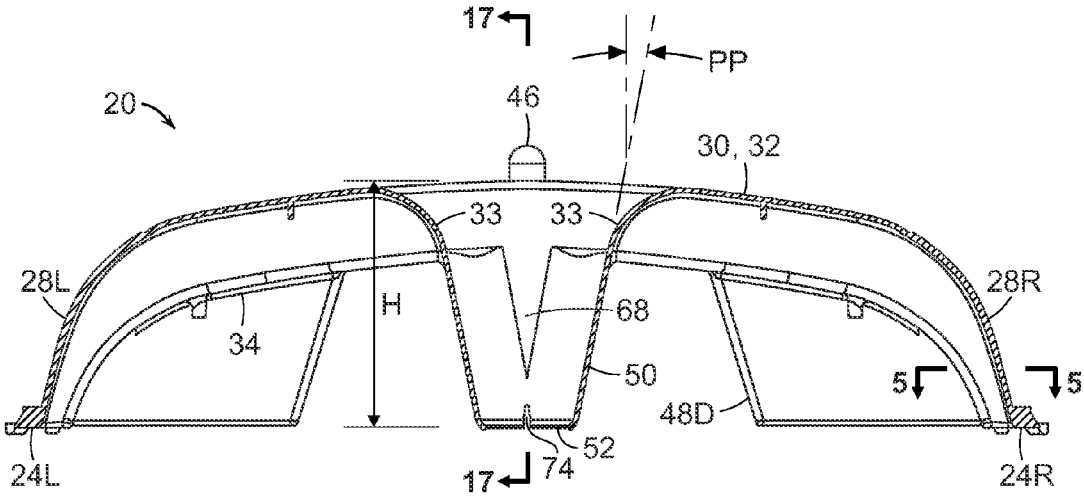
FIG. 3A is a simplified projected vertical plane cross section of the chamber of FIG. 1, through one of the center pillars.

The present invention is described in terms of a thermoplastic leaching chamber. FIGS. 1 and 2A show an injection molded thermoplastic chamber 20 in oblique view, respectively looking down on the top of the chamber and up at the bottom of the chamber. FIG. 3A is a simplified transverse vertical plane projected cross section of the chamber, through one of the center pillars. An exemplary chamber 20 may have a base width W of about 34 inches and a height H of about eight inches. The length L of the chamber is nominally 48 inches. The actual overall length is about 52 inches, so that when chambers are overlapped by means of their end connectors, each chamber contributes about 48 inches to the length of a string of chambers. The foregoing shorter dimension, i.e., 48 inches, is called the effective length of the chamber. Generally, a reference to the length dimension is reference to the effective length.

Chamber 20 has an arch shape cross section as can be seen, at least in FIG. 3A. The arch curve which defines the cross section of the chamber comprises the top 30 and opposing sidewalls 28L, 28R which run upwardly and inwardly from opposing side base flanges 24L, 24R to form an integral whole, which whole is referred to herein as the "chamber wall". (The suffixes to numbers herein generally indicate like elements. A reference to such an element by number without suffix is a reference to the generality of such elements.)

In chamber 20 a sidewall 28 ends where it transitions into the top 30; that point is typically just above the elevation at which the sidewall perforations end. FIG. 1 and most of the other views show chambers with their concave interior surfaces facing downwardly. In use, a chamber is characterized as being "concave-down."

For strength, the chamber wall comprises a multiplicity of peak corrugations 32 and valley corrugations 34. The corrugations run transverse to the length of the chamber, along the arch curve of the chamber. Corrugations are distinct from ribs, which are generally structures of less consequence, particularly with respect to section modulus. See U.S. Pat. No. 5,401,459.

Sidewalls 28 of chamber 20 curve inwardly as they rise. Top 30 is curved. In other embodiments of the invention, the sidewalls may be in whole or part planar, as detailed below, and the top could be un-curved. Thus, the term "arch curve" as used herein is to be construed loosely as referring to the path which the chamber wall follows running from one base flange, up over the top, to the opposing side base flange. Further, any reference to "arch" will include within its meaning an essentially flat arch, also called a jack arch. For brevity, the terms "peaks" and "valleys" are frequently used to refer respectively to peak corrugations and valley corrugations. Soil, as the term is used herein, refers to the natural or artificial material making up the upper layer of the earth within which a chamber is buried during use, including for example, topsoil, clay, silt, loam, fill, crushed rock, gravel and sand.

The parts of chamber 20 lie along imaginary lengthwise centerline, axis, CL, as illustrated by FIG. 1. Axis CL lies in an imaginary lengthwise vertical center plane, not shown. Chamber 20 has a central body portion, at the ends of which are opposing end walls 22P, 22D. Opposing end connectors 40, 42 are integrally attached to respective end walls 22P and 22D. The end walls have openings, so water can flow to and from the chamber body to the connectors, and thus to other interconnected chambers of an interconnected string. The connectors have dome shape portions which permit swivel interconnection of like chambers, as described further below. In use, connector 40 is overlapped by connector 42 of a like chamber.

Chamber 20 and other chambers of the invention have nominal interior volumes which comprise the space under the concave wall portion, bounded by the base plane (described below) and by two vertical end planes which are perpendicular to the length of the chamber, which are spaced apart by the effective length of the chamber, and which are equidistant from the lengthwise midpoint of the chamber. The effective length of a chamber is the increment of length added to a string of chambers when the chamber is added to the string. That is, effective length takes into account the overlap of chambers at joints.

Figure 4:
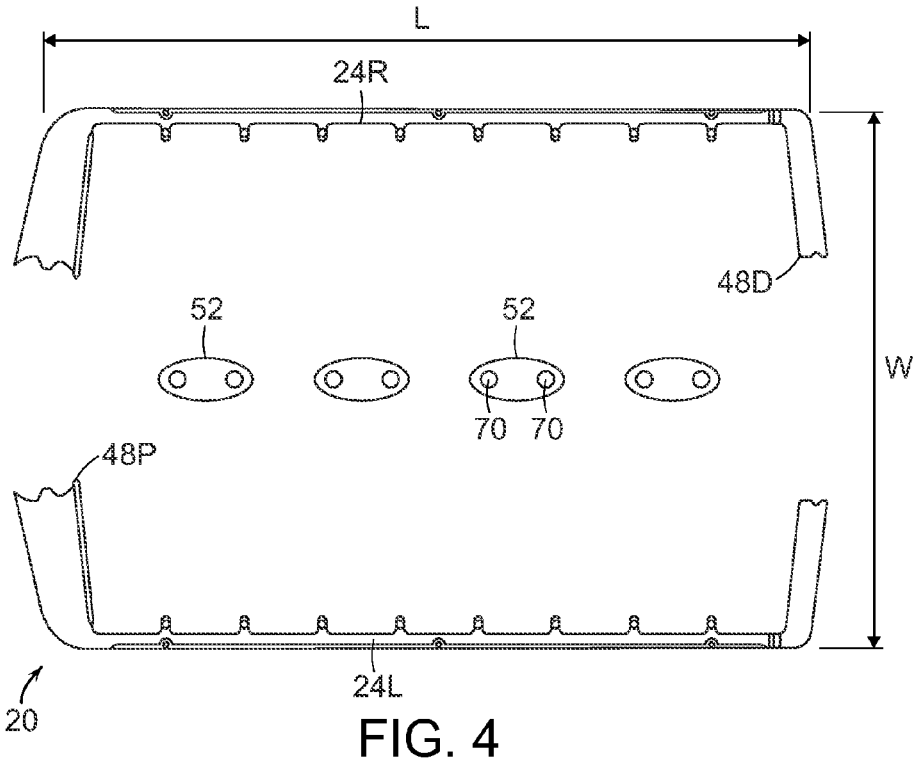
FIG. 4 is a view looking upward at the base of the chamber of FIG. 1, to show the footprint of the bottom of the chamber, with features above the plane of the base omitted for clarity.

The opposing side base flanges 24, in combination with bases 52 of the pillars 50, provide bearing area, i.e., area in contact with underlying soil, to support the chamber. Each base flange 24 runs lengthwise along the outer edge of the chamber and curves around the opposing ends to run inwardly along the bottom of the end walls. Each base flange has a C-shape in the horizontal plane when the chamber is viewed from the bottom, as seen in FIG. 4. Other embodiments of chambers may have flanges which lack the curve of the C-shape or may have flanges which extend along only part of the chamber length. Chamber 20 has familiar stacking lugs 72, or vertical fins, which extend upwardly from the base flanges to keep chambers from jamming when they are nested for shipment or storage.

Chamber 20 and other chambers of the invention have associated base planes. The base plane is an imaginary plane in which lie the opposing side base flanges 24, which base flanges may have unevenly contoured bottom surfaces. The base plane corresponds with the planar surface of soil which is exposed at the bottom of the chamber interior, when the chamber is supported on a planar soil surface during use.

The following description focuses first on pillars which support the top of a chamber. Next, the corrugation width features are described. Then, chambers having common size end connectors are described. Useful chambers may have one, two or all of the three classes of features.

Chambers and Pillars

An embodiment of the present invention has one or more interior pillars 50 which help support the chamber top. In some embodiments, pillars are positioned symmetrically along the length of the chamber body and midway between the opposing side base flanges. Exemplary chamber 20 has four center pillars 50 spaced apart along the lengthwise center plane of the chamber; and, every other peak corrugation has an associated pillar. A typical pillar 50 has a lower end which terminates at a base 52, for bearing on the soil. The horizontal portion of pillar base 52 is a flat plate which lies substantially in the base plane of the chamber. In another way of putting it, the base flanges are substantially coplanar with an imagined base plane and the base of the pillar is also substantially coplanar with the base plane.

As shown in the various Figures, a pillar base may comprise a flat plate which may or may not have openings. Pillar bases may have contours other than a flat plate. In such case, the elevation of the pillar base, for purposes of substantial co-planarity, will be determined by ascertaining the location of the mean of the contours of the surfaces which enable the pillar to bear on the soil for support.

Figure 18A:
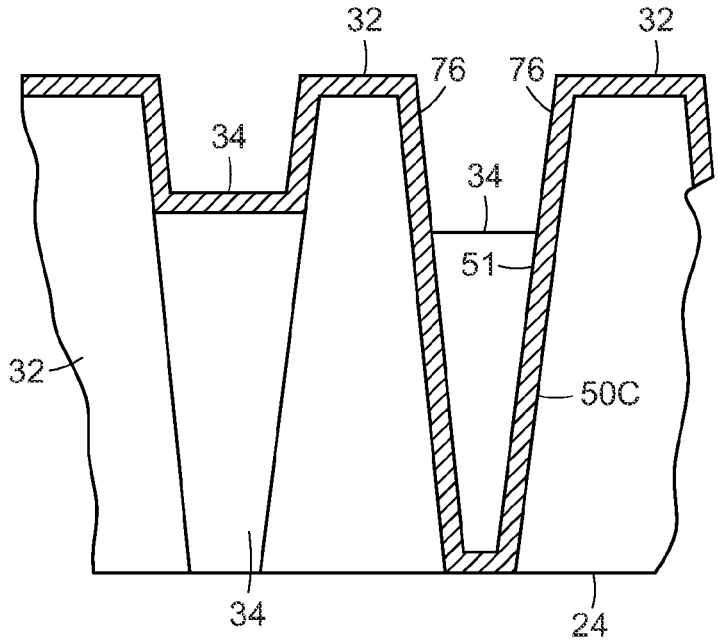
FIG. 18A is a view similar to FIG. 17, showing a chamber having a pillar which interrupts only a valley corrugation.
Figure 18B:
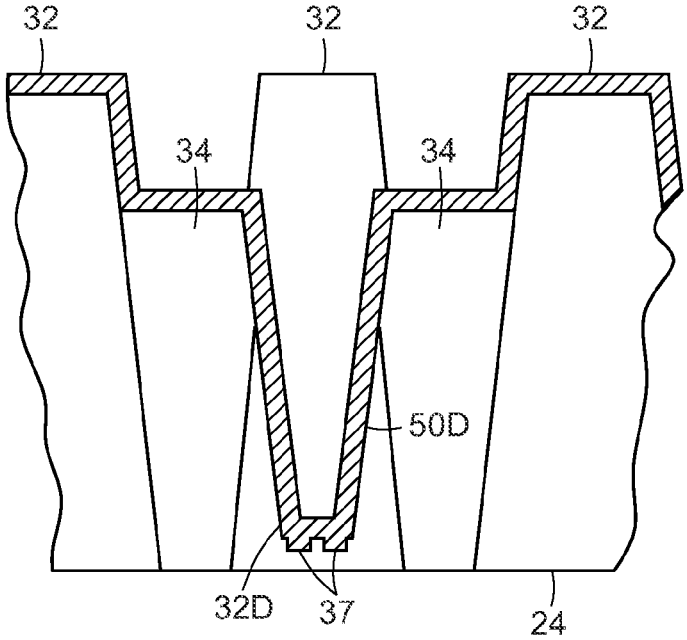
FIG. 18B is a view similar to FIG. 17, showing a chamber having a pillar which interrupts only a peak corrugation.

In other chamber embodiments, a pillar base 52 may be in proximity to the chamber base plane but may not be substantially coplanar with the chamber base plane; that is, its elevation may be somewhat above or below the base plane. For example, a pillar base which is substantially coplanar with the base plane in the "as-made" condition, may change position vertically during installation and use; the pillar base may either penetrate into the soil, or it may be pushed upward by a raised portion of soil surface. In another example, in the as-made condition the pillar base may be somewhat higher or lower in elevation than the base plane, for instance up to about one-half inch more or less, either by design or due to variation or distortion during manufacturing. When such a chamber is covered with soil or otherwise loaded, the chamber may deflect in compliance to the load, such that the elevation of the pillar base will be moved to, or more closely to, the elevation of the chamber base plane. In another alternative, the pillar base rests on an object lying on the soil surface within the chamber concavity. FIG. 18B shows a portion of exemplary chamber having pillar 50D with base 52D which is elevated from the base plane, for instance, about 0.4 inches. The pillar has small downward projecting pins 37, which penetrate into the underlying soil when the chamber is covered with soil, but which provide support on hard surfaces prior to use.

In chamber 20, the upper end of each pillar interrupts the peak corrugation beneath which it is located. Alternatively stated, there is an opening 37 in the wall of the chamber and the pillar wall is integrally connected to the chamber wall at the periphery of the opening. See FIG. 3A, FIG. 1 and other Figures. As seen in FIG. 1, the upper end of each hollow pillar 50 also interrupts the valley 34 on either side of the interrupted peak. Continuous peak corrugations 32 are adjacent the interrupted valleys.

Figure 9:
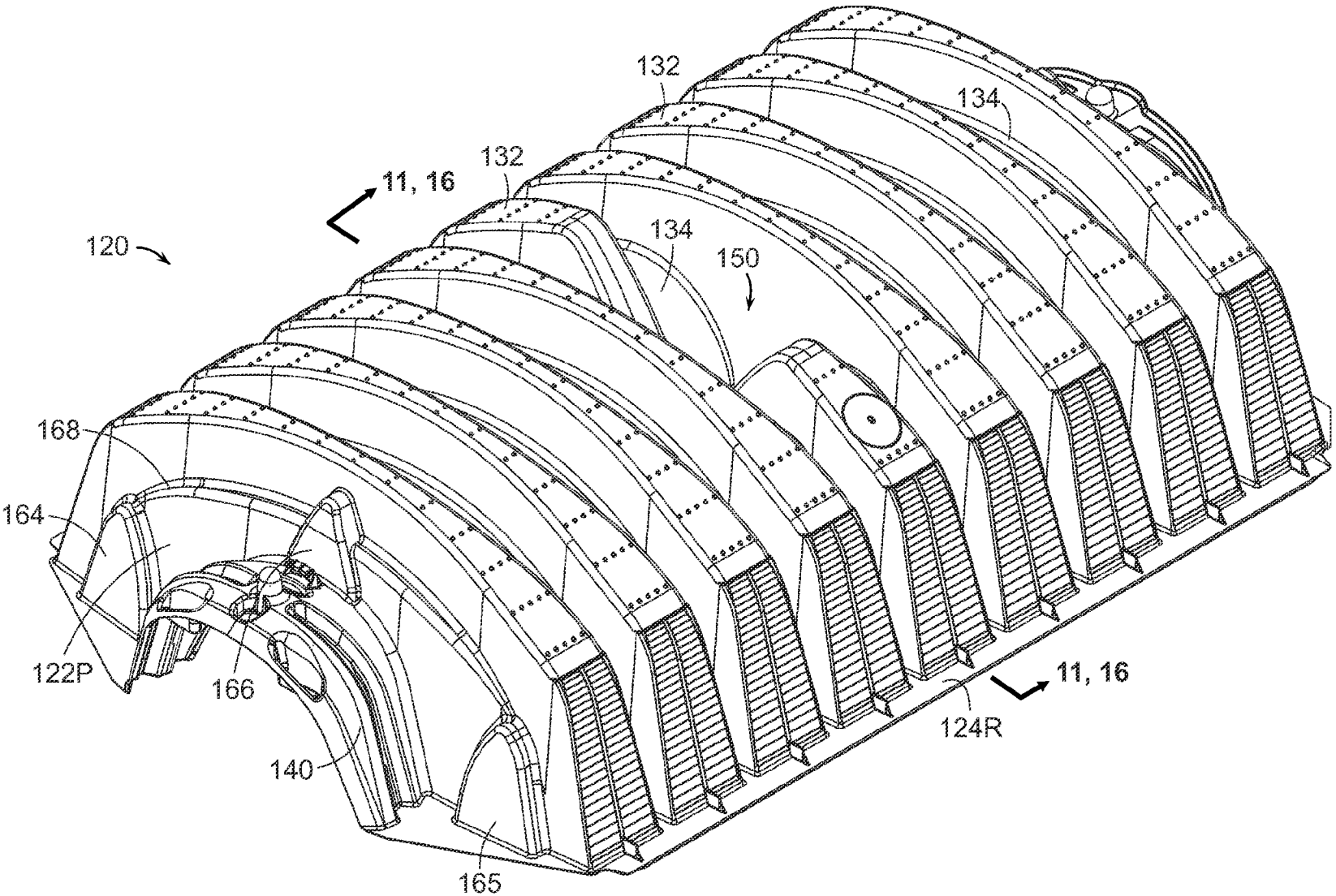
FIG. 9 is an oblique top view of a chamber having one centerline pillar.

FIG. 9 shows chamber 120 which mostly has features like chamber 20. (In chambers 120, 220 and 320, 420, etc., like features are indicated by a two digit number which corresponds with those used for chamber 20, with a prefix numeral of one, two or three, four, etc.) An exemplary chamber 120 has overall dimensions similar to chamber 20 but it has a height H of 12 inches, compared to 8 inches for chamber 120. As illustrated by the transverse cross section of FIG. 11, chamber 120 has a more crowned top and somewhat deeper corrugations than chamber 20. Chamber 120 has a single pillar 150 at the nominal midpoint of its length and width. Pillar 150 intersects the center peak corrugation 132 and the two adjacent valleys. There are four uninterrupted peak corrugations between each chamber end and the center pillar.

Figure 13:
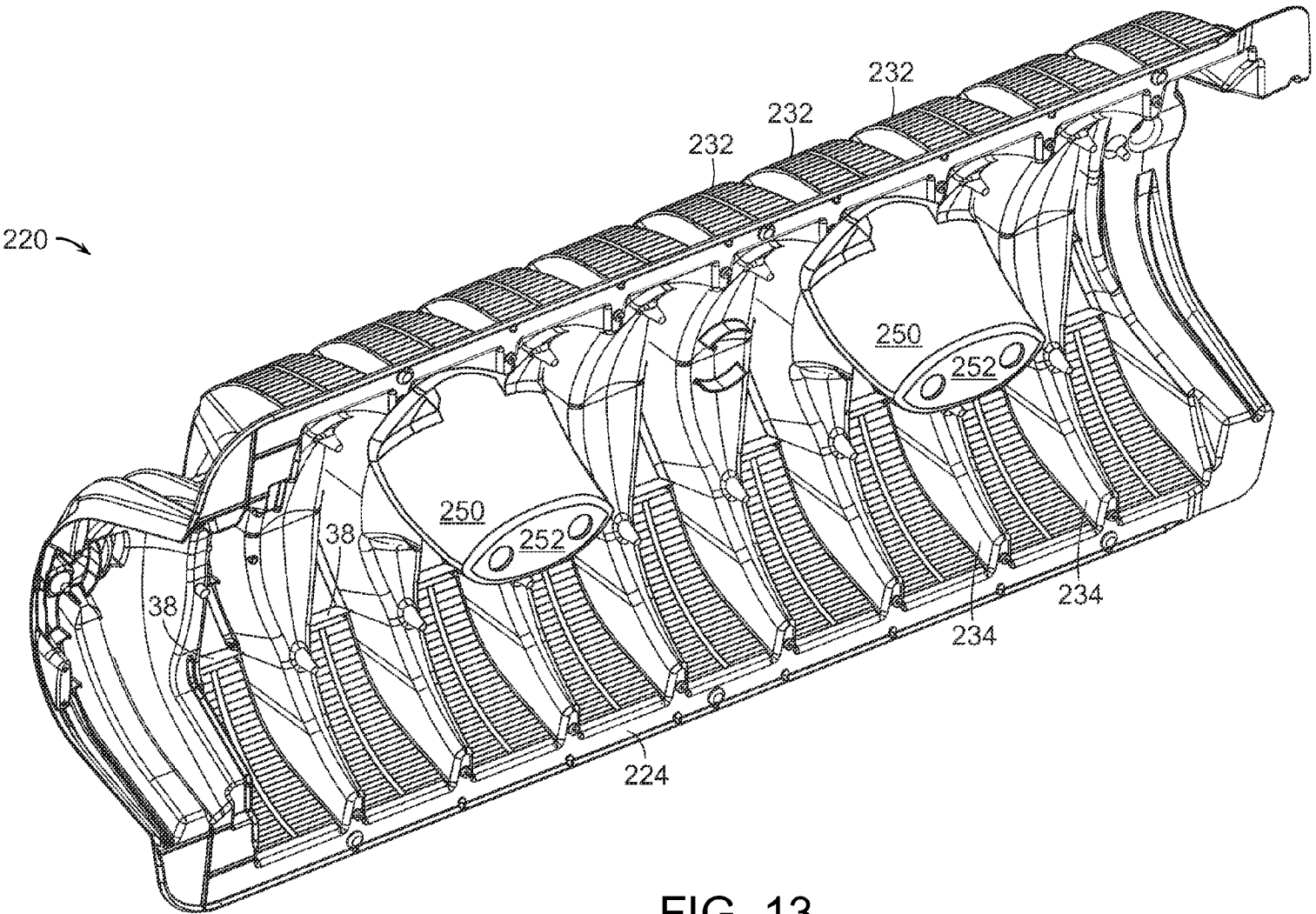
FIG. 13 is an oblique view of the underside of a chamber having two centerline pillars.

FIG. 13 shows a chamber 220, from the underside. An exemplary chamber 220 is about 22 inches wide, about 48 inches long and about 8 inches high. The chamber has 9 peak corrugations 232 and two center pillars 250, each of which interrupts a peak. Thus there are two discontinuous peaks in total. There are three continuous peaks 232 between the two pillars and two continuous peaks 232 between the end of the chamber and a pillar. In many embodiments of the invention, multiple pillars are spaced apart from each other and from the chamber end by at least one uninterrupted peak corrugation. In some embodiments, a pillar may be located at the end of the chamber, adjacent the end wall, thus interrupting a peak corrugation which is typically present at such location.

While in some embodiments pillars are symmetrically and evenly located with respect to the length of a chamber, as in chamber 20, pillars may alternatively be located asymmetrically and unevenly. For example, asymmetry is necessarily the case for a chamber having a single pillar and an even number of peak corrugations, if the pillar is to be centered upon a peak corrugation.

Figure 14:
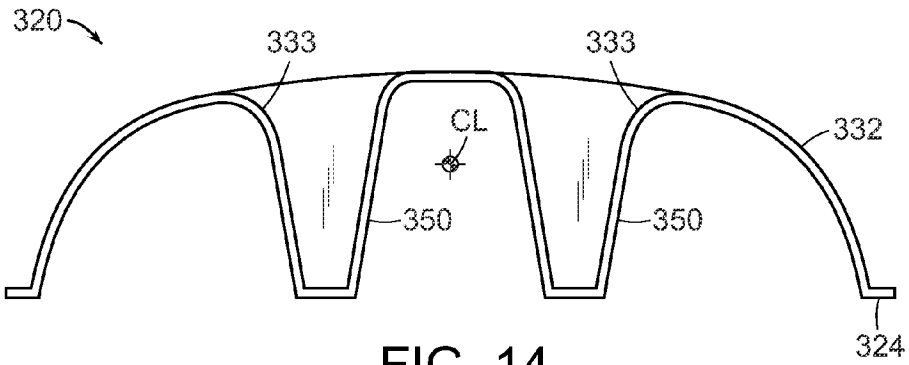
FIG. 14 is a simplified vertical plane cross section of a chamber which has a pair of pillars at the location of a peak corrugation, each pillar spaced apart from the lengthwise centerline.

Pillars may be nominally located along the centerline CL of the chamber, as described thus far and as illustrated in FIG. 1. In alternate embodiments, all the pillars may be present as transversely spaced apart pairs. The vertical cross section of FIG. 14 shows a chamber 320 having a pair of pillars 350 which are offset left-right from the lengthwise centerline and interrupt peak corrugation 330. In another alternative chamber, not shown, the pillars may be staggered along the length of the chamber, i.e., looking along the length of the chamber, a first pillar would lie to the left of the centerline, the next pillar would be offset to the right, and so forth.

Pillars provide strength to chambers. When present, they enable a chamber to have lesser thickness of wall, or to have less of a curve to the arch, or to have lesser depth or number of corrugations, or to have less or no ribbing, compared to what would be otherwise necessary for adequate strength. Alternately, pillars increase the strength capability of a chamber which is otherwise adequate.

When installed and covered with about 12 inch of compacted backfill, the chambers of the invention preferably have strength sufficient to meet particular regulatory standards. Various embodiments of the invention will be compliant with the standard published by the International Association of Plumbing and Mechanical Officials (IAPMO), known as "Material and Property Standard for Leaching Chambers" and numbered "IAPMO PS 63-2005", at least with respect to Section 4 General Requirements and Testing Requirements and Section 6.1 where the chamber is a Normal Duty H-10 Unit. The H-10 rating derives from American Association of State Highway and Transport Officials (AASHTO) Standard Specifications for Highway Bridges and involves subjecting a chamber to withstand a vertical load from a 16,000 pound vehicle axle, when the chamber has 12 inches of backfill cover. Said IAPMO standard is hereby incorporated by reference in its entirety.

Pillar embodiments like pillar 50 have a wall which projects downwardly into the interior of the chamber. The wall tapers inwardly toward the center of the pillar as the pillar wall runs downwardly to the elevation of the chamber base. If viewed as a hollow truncated cone, the narrow end of the cone is at the lower end of the pillar. The tapers of the pillar walls and other features of the pillars are preferably designed to enable the pillar of a second chamber which is placed on top of first chamber to nest within the first chamber with a desired stack height. Stack height is the vertical dimension between corresponding features of two chambers, when they are nested, one upon the other, to form a stack for shipment or storage. A stack height of less than two inches is preferred. More preferably, the stack height is less than one inch.

An exemplary pillar has an approximately conical shape wall which angles outwardly at 2 to 12 degrees, as indicated by angle PP in FIG. 3A. In various embodiments, the angle PP of the pillar wall with respect to the vertical may vary locally at different portions of the pillar; it may vary along the length and or around the periphery of the pillar. Generally, the pillar walls may have other columnar shapes; for instance, they may have steps.

Figure 10:
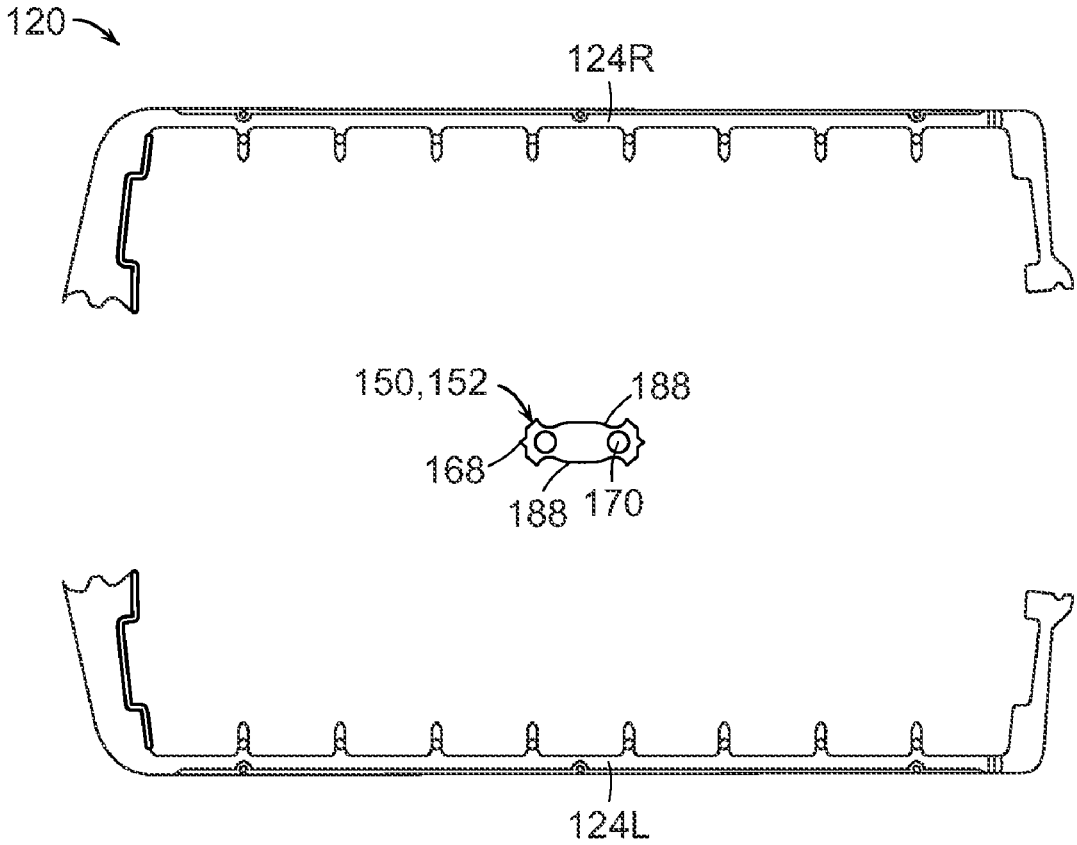
FIG. 10 is a view of the chamber of FIG. 9, like the view shown in FIG. 4.

Pillars may have protuberances called here sponsons 68, which run upwardly at one or both lengthwise sides of the pillar. (The length and width dimensions of a pillar correspond in direction with the length and width of a chamber. The vertical dimension is called the height.) See FIG. 2A and FIG. 3A. Sponsons provide rigidity to the pillars. When present, sponsons have tapers like the pillars, to enable nesting and they are shaped to enable easy unstacking (also called de-nesting and un-nesting). Sponsons may die out as they run downwardly toward the pillar base, or they may continue down to the pillar base. FIG. 10 shows other exemplary sponsons 168.

Figure 17:
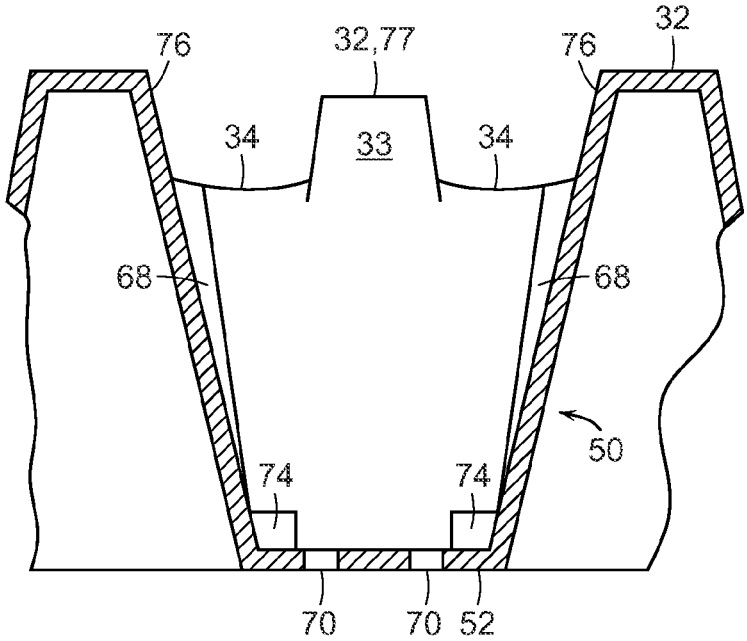
FIG. 17 is a partial lengthwise vertical plane cross section through a pillar of a chamber like the chamber of FIG. 3A, where the pillar interrupts a peak corrugation and both adjacent valleys.

Pillars may have internal ribbing 74 that connects the pillar side wall and pillar bottom, for strength, as shown in FIG. 17. Ribbing 74 may also function as stacking lugs like the fins 72. As seen in FIG. 4, FIG. 10, and elsewhere, the bases of the pillar may have one or more holes 70, 170. Those holes serve as drains fear any water falling into the pillar before or after installation, and they allow the core and cavity mold parts to interlock during molding for dimensional control. Portions of the upper ends of pillars 50 blend into the webs 76 of the two continuous peak corrugations 32 which abut the interrupted peak corrugation 32. Webs are described further below. Exemplary pillar 50 has a width which is smaller than the pillar length, thus minimizing the length of interruption of the interrupted peak corrugation 32. In other embodiments, pillars may have different length and width relationships. Chamber 620 in FIGS. 21 and 22 has pillars with width greater than length.

Figures 15A, 15B, 15C, 15D, 15E, 15F:
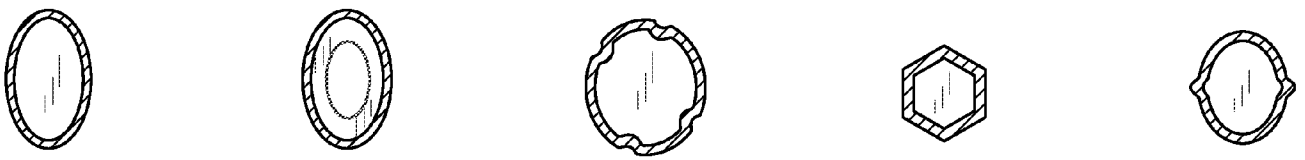
FIG. 15(*a*) through FIG. 15(*f*) show cross section views of the lower ends of alternative pillars, in a horizontal plane which is just above the elevation of the base plane of the chamber.

The pillars 50, 150, 250 of exemplary chambers have a horizontal plane cross section which is oblong, as shown in the FIG. 4, with the greater length axis parallel to the chamber length. The horizontal plane cross section of a pillar may be selected from a multiplicity of shapes, including regular and irregular shapes. FIG. 15 shows exemplary cross sections of pillars proximate the elevation of the pillar base. FIG. 15(*a*) through 15(*f*) show different pillar cross sections, including round, octagonal, square and other. See also the shape of pillar base 152 of chamber 120, shown in FIG. 10. See also the pillar base of the chamber of FIG. 21. The foregoing and other cross sections, can characterize the pillar at any elevation. The cross section of a pillar can vary along the height of the pillar. All the pillars of a particular chamber may have the same cross section, or the cross section may differ amongst pillars within a chamber.

A pillar may have other vertical cross section dimensions. FIGS. 17, 18A and 18B show simplified portions of different chambers, each cross sectioned along the chamber vertical lengthwise center-plane. FIG. 17 shows a pillar like the pillar 50 of chamber 20. The pillar 50 interrupts both the peak corrugation 32, 77 and adjacent valley corrugations 34. The upper end of the pillar, or alternatively stated, the opening in the top of the wall of the chamber, has a length which is nominally equal to the distance between the webs 76 that are associated with the continuous peak corrugations 32 which are on either side of the peak corrugation 77 and adjacent valley corrugations which are interrupted by the pillar.

In FIG. 18B, the upper end of the pillar 50D only interrupts a peak corrugation 32 and does not interrupt any adjacent valley. Chambers may have still other arrangements of pillars. For example, a pillar may interrupt one peak corrugation and one adjacent valley corrugation only; a pillar may interrupt a portion, but not the whole, of a peak corrugation or a valley corrugation; and, a pillar may interrupt a multiplicity of peak and valley corrugations.

Figure 21:
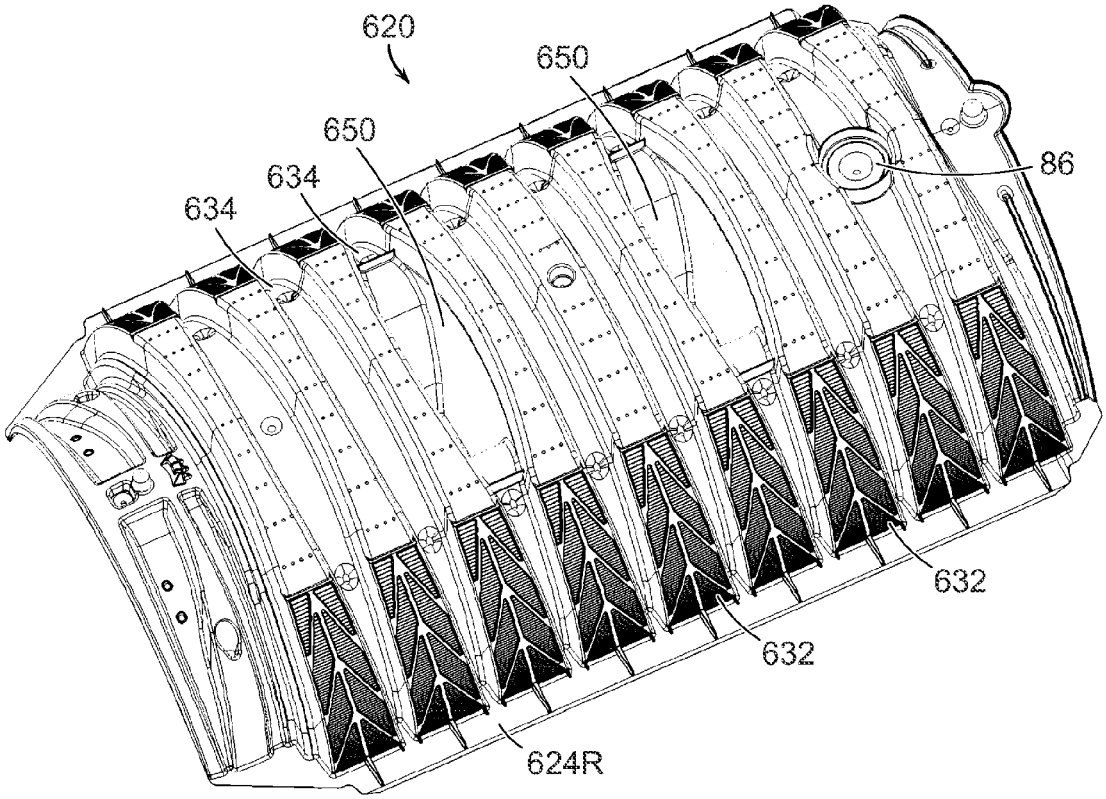
FIG. 21 is a top oblique view of a chamber having pillars, whose widths are greater than their lengths, centered on valley corrugations.
Figure 22:
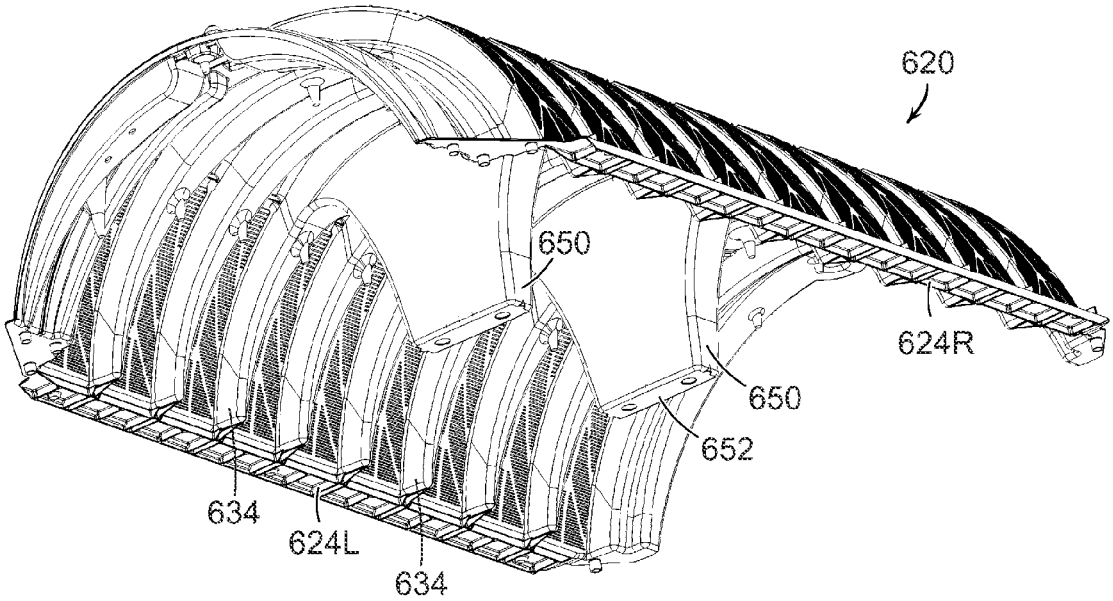
FIG. 22 is an oblique view of the bottom of the chamber shown in FIG. 21.

In FIG. 18A, pillar 50C has an upper end 51 which intersects only a valley 34. Thus, the length of the pillar is equal to the length of the valley and no peak corrugation is interrupted. FIG. 21 and FIG. 22 respectively show top and bottom views of chamber 620 which has two pillars 650, each of which interrupts only a valley corrugation 634. Note that pillar 650 has a width which is greater than the pillar length. Chamber 620 has a boss 86 which defines a region where a port may be cut for inspection or vertical entry of a pipe. The base flanges 624 of chamber 620 are strengthened by ribbing.

Figure 20:
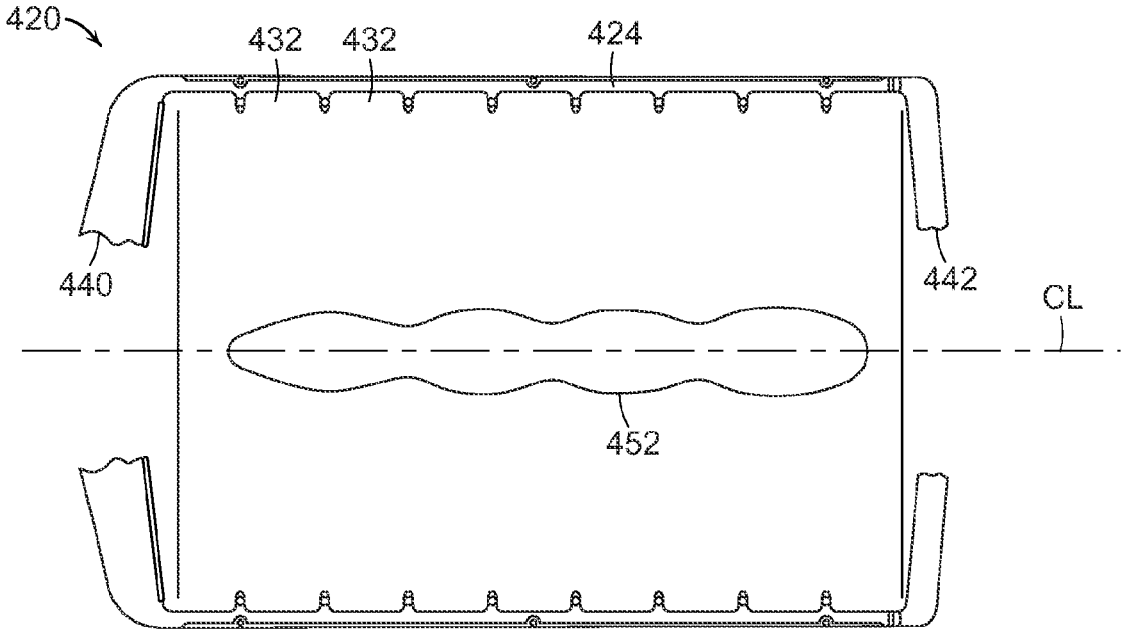
FIG. 20 is a view like FIG. 4 showing a chamber having a long center pillar.

The center pillar may interrupt a multiplicity of adjacent peak and valley corrugations when the pillar length is a large fraction of the length of the chamber body. For example, FIG. 20, which is a view like FIG. 4, shows the bottom of a chamber 420. Center pillar 450 has a length that extends almost all the length of the chamber, to proximity of the ends 440, 442.

In some embodiments, the pillar opening which is in a valley, as shown in FIG. 18A, is made longer than otherwise would be the case by thinning the widths of the upper portions of the peak corrugations which abut the opening, or by locally changing the angle of the web which runs down to the pillar opening. With reference to FIG. 18A, the webs 76 on either side of the opening of pillar 50C may be moved left-right in the Figure.

The opening at the top of a pillar enables soil to fill the interiors of the pillar. This has been conceived as providing the pillar with greater strength than if the pillar were left free of any soil, as is the case when a pillar has a closed upper end.

The shapes of the upper ends of an interrupted corrugation, in proximity to the upper end of the pillar, desirably have special features which ease removal of a chamber from the top of a stack of nested chambers. Lifting a chamber vertically from the stack can present difficulties if one person is doing the lifting, and the stack is high relative to a person's height. When chambers are nested, and a person instead lifts one side base flange, in order to rotate a first nested chamber upwardly from the top of the stack, the interrupted corrugations and pillar of the lifted chamber may jam against the corresponding features of the underlying chamber.

Figure 11:
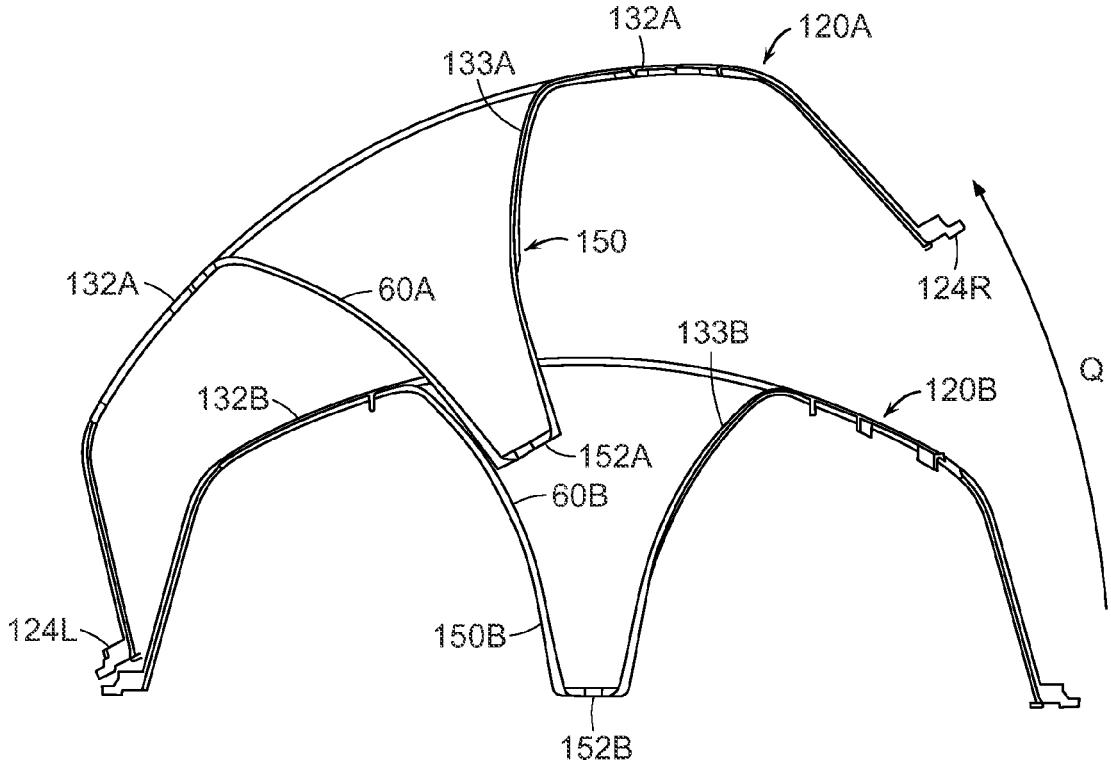
FIG. 11 is a vertical plane cross section of the chamber of FIG. 9, at the pillar location, in combination with a second like chamber, lifted up at an angle from a nested position on the first chamber.

To avoid such jamming, the upper or terminal ends of interrupted corrugations, and the pillars, are specially contoured. FIG. 11 is a simplified transverse cross section view showing two identical chambers 120A, 120B. It illustrates the motion of a chamber 120A as it is rotated upwardly from its initial stacked position where it rests upon underlying chamber 120B, when a person lifts flange 124R. The lifting motion is suggested by arrow Q. To avoid chamber-jamming, the terminal ends 133A, 133B of the interrupted peak corrugations 132A, 132B (along with the ends of the valley corrugations, when applicable), and the pillars are specially shaped. The pillars and corrugation ends have curved surfaces 60A, 60B, which approximately lie along an arc path defined by a radius centered at the base flange 124L. The radius length is the nominal distance between side base flange 124L and a point, which point is where the pillar wall 60A intersects the pillar base 152A. When nested, and when being lifted, by design there is typically a small lateral (horizontal) offset between the exterior surface of the underlying chamber and the mating interior surface of the overlying chamber, for clearance.

In other embodiments of chambers which have the desirable un-stacking characteristic just described, the surfaces 60A, 60B may have contours other than the radiused curves, provided the contours are not a greater distance from flange 124L than just described.

In actual practice, the rotation referred to is often not a pure rotational movement. When a stack of chambers are nested together, lifting one side base flange of the topmost chamber, in order to de-nest and remove that topmost chamber from the stack of chambers, may cause the opposing side base flange (about which the topmost chamber is being rotated) to slip off the side base flange immediately below it. Therefore, the rotational movement involved in lifting one side base flange of the topmost chamber may also contain some small degree of lateral movement as well; and, it may comprise simultaneous whole-lifting.

Figure 2B:
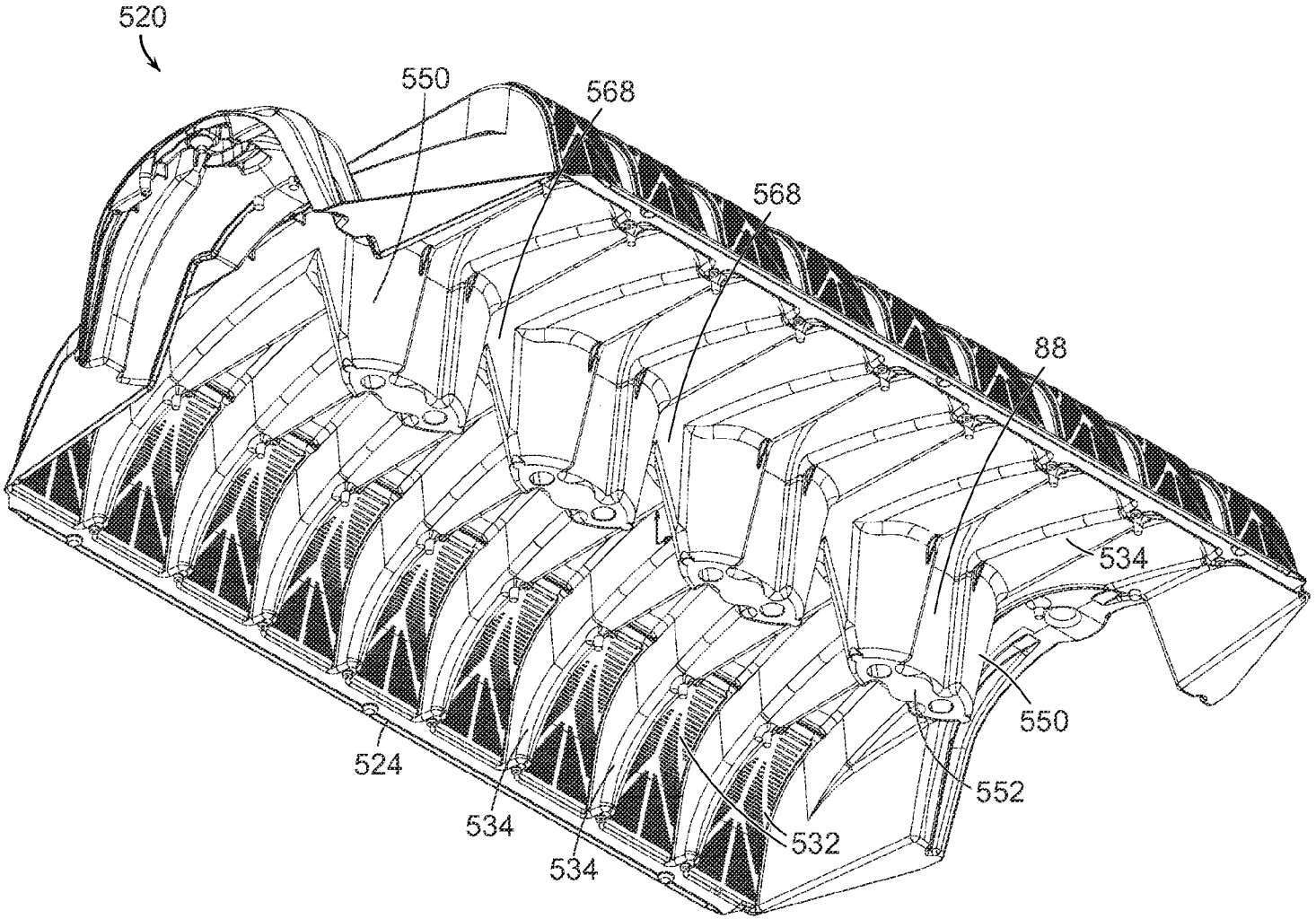
FIG. 2B is an oblique bottom view of a chamber which has pillars with corrugations but is otherwise like the chamber in FIG. 2A.

In chamber 20, the interrupted peak corrugations 32 end in vicinity of the upper end of a pillar 50. FIG. 2B shows chamber 520. It is like chamber 20 except that the pillars 550 have vertical corrugations 88 which run upwardly to connect with the ends of the peak corrugations 532. Alternatively stated, the corrugations 532 continue down the height of the pillar wall in the form of corrugations 88. Chamber 120, shown in FIG. 9 and FIG. 10, is another example of the pillar design embodied by chamber 520. Pillar 150 has corrugations 188, the contours of which connect with the contours of the interrupted peak corrugation 532, and the corrugations 188 continue down to the base 152 as shown in FIG. 10.

Data for exemplary chambers 20, 120, 220 are given in Table 1. As the illustrations evidence, those three chambers have a combination of one or more center pillars and the desirable peak to valley corrugation width relations which are discussed in the next section.

First, with respect to bearing area: The load applied to a chamber by overlying soil and any object on the soil surface is transferred to the bottom parts of the chamber, which bear on the soil on which the chamber rests during use. (Bearing area here refers to the same measure as does "bearing footprint" used in the IAPMO standard referred to above.) The bearing area of a chamber comprises the summation of flange areas and pillar areas which support the chamber on soil. The bearing area for the invention chambers is provided by the combination of base flanges 24, 124, 224, 324, 424, 524, 624, 724 and respective pillar bases 52, 152, 252, 350, 452, 552, 652, 752. In typical chambers of the invention, the pillars may provide bearing area of between 4 and 25 percent, more preferably between 4 and 17 percent of the total bearing area of the chamber.

Second, with respect to leaching area: The leaching area of a chamber is the total of open area (a), namely, the leaching area provided by the open area of exposed soil at the bottom of the chamber, and open area (b), namely, the leaching area provided by the exposed soil at the sidewall perforations. The open area (a) is measured at the base plane elevation; it is referred to here as the "open base area." The open base area is that which lies beneath the concavity of the chamber within the effective length of the chamber. Thus it is bounded lengthwise by the vertical planes which determine effective length, described elsewhere here, and it is bounded transversely by the inner surfaces of the base flanges which contact soil during use. The open area (b) is the soil area which is exposed at the perforations in the sidewalls. When the perforations are slots, the area (b) is the summation of the areas at each slot opening. Making reference to the sidewall cross section in FIG. 8, the leaching area in a slot is taken as the calculated area of plane PS. Plane PS is a plane which runs from the inner edge 75 of a first louver 37 to the outer edge 77 of the overlying louver 37. To the extent such edges are curved surfaces, the plane PS is tangent to the edges at the inner and outer locations. If a perforations has a shape other than a slot, the leaching area is analogously calculated, according to the largest plane which fills the opening.

The bearing area portion of any pillar base undesirably takes away from the available leaching area of the chamber bottom because it locally masks the soil. By example of chamber 20 in Table 1, the bearing area of the bases of the pillars is 27 square inches. That is less than two percent of the 1714 square inch total leaching area of the chamber (i.e., the summation of the area of the exposed base and the sidewall slot openings). The other chambers have comparable less-than two percent data, with respect to pillar masking.

The exemplary chambers provide a ratio of leaching area in square inches to plastic volume in cubic inches of at least 5 $inch^3$ to 1 $inch^2$; for example between about 5.4 $inch^3$ to 1 $inch^2$ and about 5.6 $inch^3$ to 1 $inch^2$. And they provide a ratio of storage volume to plastic volume of at least 20 to 1, for example between about 20 to 1 and about 33 to 1.

Figure 3B:
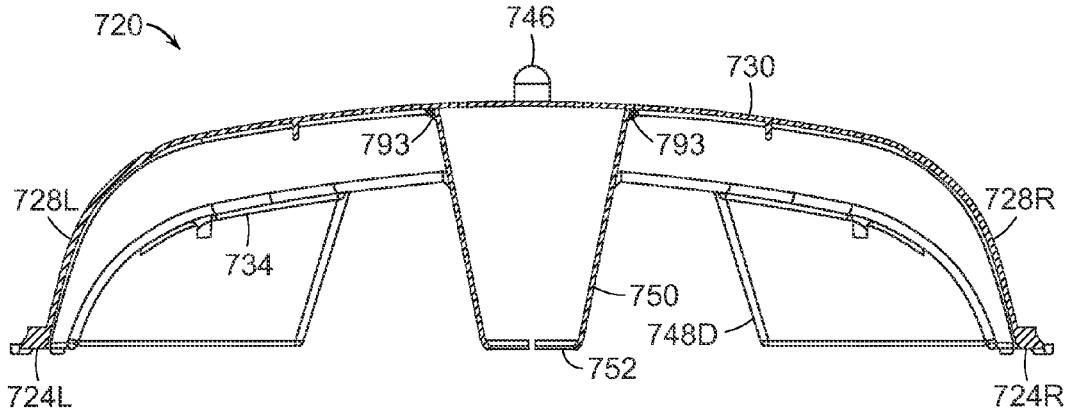
FIG. 3B is a view like that of FIG. 3A, showing a chamber having a pillar with a closed top.

FIG. 3B is a cross section of a chamber 720. The view is like that of FIG. 3A. Pillar 750 is a hollow cone shaped like other pillars that have been described. The upper end of the pillar is attached to the interior of the top 730 of chamber 720 by means of welding or bonding at joint 793. Alternatively, the pillar may be attached by means of mechanical fasteners, by interlocking structures, and so forth. In a variation, the pillar may be a straight cylinder. In chamber 720, there is no interruption of the peak or valley corrugations. However, chamber 720 will not nest with like chambers, and that means it has poor storage and shipping characteristics. Thus, a practical way of making and using chamber 720 would comprise attaching the pillar to the chamber in the field, at the point of installation. In such embodiments, an appropriate attachment means would be a quick mechanical interconnect, such as a snap-together joint, or a vertical bolt, etc.

When chambers are used for leaching wastewater, it is an aim to maximize the storage volume and leaching area, both on a "per linear foot of chamber" basis and on a "per weight (volume) of plastic" basis. See U.S. Pat. No. 7,465,122, the disclosure of which is hereby incorporated by reference. In the present invention, the shape and size of the pillars does not greatly diminish the storage volume of the leaching chamber. As indicated above, exemplary chambers have good leaching areas and other parametrics.

TABLE 1

Characteristics of exemplary four-foot long chambers

| Chamber embodiment | Pillar Qty. | Bearing area of pillars (sq. inch) | Bearing area of flanges (sq. inch) | Total bearing area (sq. inch) | Leaching area (sq. inch) | Storage volume (cu. inch) | Amount of plastic (cu. inch) |
|---|---|---|---|---|---|---|---|
| Chamber 20 | 4 | | | | | | |
| (W = 34 inch, 11 = 8 inch) | | 27 | 131 | 158 | 1714 | | |
| square inches | | | | | | | |
| cubic inches | | | | | | 7422 | 304 |
| % of total bearing area | | 17 | 83 | 100 | | | |
| Chamber 220 | 2 | | | | | | |

TABLE 1-continued

| Characteristics of exemplary four-foot long chambers | | | | | | | |
|---|---|---|---|---|---|---|---|
| Chamber embodiment | Pillar Qty. | Bearing area of pillars (sq. inch) | Bearing area of flanges (sq. inch) | Total bearing area (sq. inch) | Leaching area (sq. inch) | Storage volume (cu. inch) | Amount of plastic (cu. inch) |
| (W = 22 inch, H = 8 inch) square inches | | 15 | 150 | 165 | 1218 | | |
| cubic inches | | | | | | 4611 | 225 |
| % of total bearing area | | 9 | 91 | 100 | | | |
| Chamber 120 (W = 34 inch, H = 12 inch) square inches | 1 | 8.5 | 153 | 161 | 1774 | | |
| cubic inches | | | | | | 10838 | 321 |
| % of total bearing area | | 5 | 95 | 100 | | | |

Based on a nominal 0.034 lb per cu. inch density of plastic, characteristic of certain polyolefins, the leaching area per pound of plastic for each chamber 20, 220, 120 is respectively about 165, 159, 162 square inches per pound; thus, an exemplary chamber has at least 160 square inches of leaching area per pound of plastic which comprises the chamber. The chambers 20, 220, 120 weigh respectively about 10.3, 7.7 and 10.4 pounds. And, given the nominal 4 foot effective length, the chambers 20, 220, 120 respectively weigh about 2.6, 1.9 and 2.7 pounds per linear foot. With respect to the 34 inch wide chambers (i.e., chambers 20 and 120), the chambers weigh less than 2.8 pounds per foot, and have a leaching area of at least 428 square inches per foot.

The present invention includes: A molded plastic leaching chamber which comprises opposing side base flanges spaced apart on either side of the lengthwise vertical center-plane of the chamber, wherein the opposing side flanges are substantially coplanar in a base plane, and a chamber wall connecting the opposing side base flanges and defining a concavity; along with the improvement which comprises at least one hollow pillar integral with the chamber wall, wherein the pillar tapers downward and inward into the concavity from an opening in the chamber wall to a pillar base which is substantially coplanar with the base plane. In embodiments of the foregoing:

1. A chamber has a height which is less than 11 inches and width greater than 30 inches.
2. The chamber is shaped (a) to be nestable on top of a like chamber with a stacking height of less than 2 inches and (b) to be removable from the like chamber below by lifting one side base flange and rotating the chamber about the opposing side base flange.
3. The chamber wall comprises alternating peak and valley corrugations, and wherein at least one peak or valley corrugation continues into at least a portion of at least one pillar.
4. The area of the pillar base in the base plane of the chamber is between about 4 and 25 percent, preferably between about 4 and 15 percent, of the sum of the area of the base plane of the side base flanges and the pillar base.
5. The chamber is compliant with the Section 4 General Requirements and meets the testing requirements of an H-10 load rating in Section 6 Testing Requirements of the International Association of Plumbing and Mechanical Officials, Material and Property Standard for Plastic Leaching Chambers IAPMO PS 63-2005.

The present invention also includes: A plastic leaching chamber having an arch shape cross section, for receiving and dispersing water when buried beneath the surface of soil, comprising: opposing side base flanges, spaced apart on either side of the lengthwise vertical center-plane of the chamber, for providing bearing area to support the chamber during use; opposing sidewalls, each sidewall running upwardly and inwardly from a base flange and having a plurality of perforations; a top, connecting the upper ends of the sidewalls; wherein the sidewalls and top form an arch shape wall which defines a concave chamber interior, said arch shape wall having alternating peak corrugations and valley corrugations running transverse to the length of the chamber; and, one or more hollow pillars, each pillar extending downwardly into the chamber interior from the top of the chamber, and each pillar comprising a pillar base which is in proximity to the plane as the base flanges. In embodiments of the foregoing:

1. Each of the one or more pillars has an open upper end and extends downwardly from an opening at the top of the chamber; and, each pillar tapers inwardly in the downward direction.

2. Each pillar is shaped so that the chamber is removable from the top of a stack of nested identical chambers by upwardly lifting one base flange, to thereby rotate the chamber in a plane which is transverse to said lengthwise center plane.

3. The chamber wall and pillar are made of a single piece of injection molded thermoplastic; wherein each pillar base has one or more openings lying in a plane parallel to said base plane; wherein said perforations comprise slots spaced apart horizontally and vertically on the peak corrugations; wherein the flanges have C-shape configurations in said base plane; further comprising a dome shape connector at each lengthwise end of the chamber, for forming underlapping-overlapping connections with like chambers.

4. The total footprint bearing area of said one or more pillars is between about 4 and 25 percent, preferably between about 4 and 15 percent, of the total bearing area of the chamber.

5. The chamber is compliant with both Section 4 and Section 6.1 for an H-10 Load Rating, in International Association of Plumbing and Mechanical Officials Material and Property Standard for Leaching Chambers, IAPMO PS 63-2005.
6. Each pillar has a vertically running corrugation or sponson.

The present invention further includes: A molded plastic chamber for collecting, receiving, detaining, or dispersing water when buried, comprising: (a) a first end and a second end separated along a lengthwise direction; (b) a first side and a second side separated along a widthwise direction perpendicular to the lengthwise direction; (c) a first side base flange, at least part of which extends lengthwise along part of the first side, and a second side base flange, at least part of which extends lengthwise along part of the second side, which side base flanges are separated from each other in the widthwise direction and are substantially coplanar with a base plane; (d) a chamber wall connecting the first side base flange to the second side base flange and forming a concavity below the chamber wall; and, (e) one or more pillars, each pillar comprising a pillar wall (i) which is integrally connected with the chamber wall at the perimeter of a hole in the chamber wall; (ii) which has an inward taper from the chamber wall down to a pillar base which pillar base comprises a portion which is substantially parallel to the base plane and either co-planar with or below the base plane; and, (iii) which surrounds a hollow space which is in communication with the exterior space. In embodiments of the foregoing:

1. The chamber height is less than 11 inches and the chamber width is greater than 30 inches.
2. The chamber wall and pillars are shaped to permit the chamber (a) to be nestable on top of a like chamber with a stacking height of less than 2 inches and (b) to be removable from the like chamber below by lifting one side base flange and rotating the chamber about the opposing side base flange.
3. The chamber is compliant with the Section 4 General Requirements and meets the testing requirements of an H-10 load rating in Section 6 Testing Requirements of the International Association of Plumbing and Mechanical Officials, Material and Property Standard for Plastic Leaching Chambers IAPMO PS 63-2005.
4. The bearing footprint area of the chamber divided by the effective length of the chamber equals or exceeds 20 square inches per lineal foot, wherein the open base area divided by the effective length exceeds 2.2 square feet per lineal foot and wherein the chamber effective volume divided by the effective length exceeds 0.9 cubic feet per lineal foot.
5. The pillar base is longer in the widthwise direction than in the lengthwise direction and wherein the pillar base has a through hole.
6. At least part of the chamber wall has peak corrugations and valley corrugations and wherein the hole in the chamber wall is centered on a valley corrugation.

Thus, it is seen that pillars are effective in providing support to chambers without substantially diminishing significantly the leaching area functionality of the chamber, compared to a same-size pillar-free chamber. Use of pillars enables a chamber to have less arch crowning for a given design strength of top. Less crowned tops provide increased storage volume. Chambers have good storage volume, notwithstanding the subtractive volumes of the pillars. The invention chambers provide superior performance which is attributable to the combination of center pillars and peak to valley corrugation width relations. Pillars of the present invention can be used in chambers which either do or do not also have the unique peak and corrugation width configurations which are described in the next section. Pillars of the present invention may be used in chambers which lack corrugations and in chambers which lack sidewall perforations.

Chambers Having Wide Peaks and Narrow Valleys

Another aspect of the present invention relates to the special relationships between widths PW of the peak corrugations to widths VW of valley corrugations. Some or all of peak and valley corrugations along the length of the chambers comprise peak corrugations which have particularly great widths compared to the widths of the valley corrugations with which they are alternated, measured in the lengthwise dimension of the chamber, near the base flanges. See FIG. 5B. Exemplary chambers have slot perforations only in the peak corrugations and utilize one or more pillars which have been described above. However, other chamber embodiments may comprise perforated valleys, may lack pillars, or may lack perforations.

With reference to the several Figures, the opposing sidewalls 28 cant inwardly. The sidewalls curve inwardly as shown in FIG. 1. Alternatively, the sidewall may be in part or whole planar as it rises from the base, with a sharp, transition to a curve where the upper end of the sidewall joins the top 30.

Along the length of the exemplary chamber of FIG. 1, the preponderance of the sidewall 28 comprises perforated peak corrugation portions 26, in particular, the slotted portions which are pictured. Other shape perforations in the sidewalls, such as round or oblong holes, may be used in the invention. The term perforation is used here in the general sense of meaning a through-hole or opening, without limitation with respect to how the perforation is formed. In injection molded chambers the perforations are typically formed during the molding step. In thermoformed chambers the perforations are typically formed after molding by cutting, piercing, punching, or drilling, etc.

Referring to FIG. 1, each corrugation 32, 34 rises from a base flange on a first side, runs up over the chamber top and down to the other side base flange. The corrugations are continuous except as they are associated with pillars 50, such as interrupted peak corrugation 32, when pillars are present. Adjacent peaks and the valleys share a web 76. See FIG. 5A and FIG. 17. Peak corrugations diminish in width with elevation from the base flanges, and the valley corrugations increase in width with elevation.

Figure 5A:
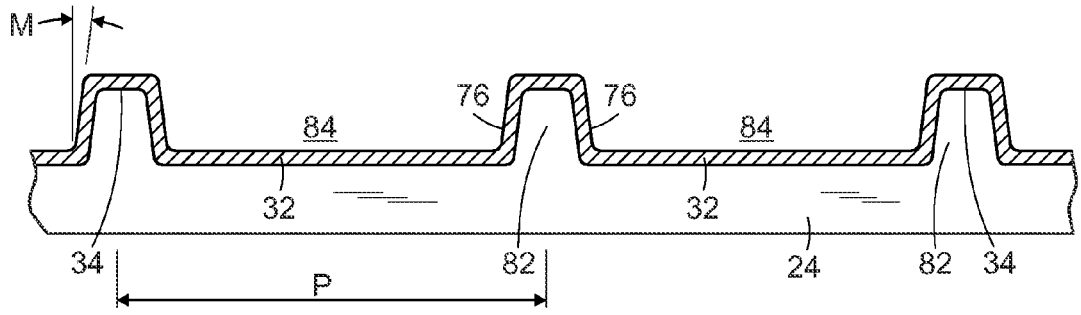
FIG. 5A is a horizontal plane cross section view of corrugations of the chamber of FIG. 1, near the elevation of the base flange.
Figure 6:
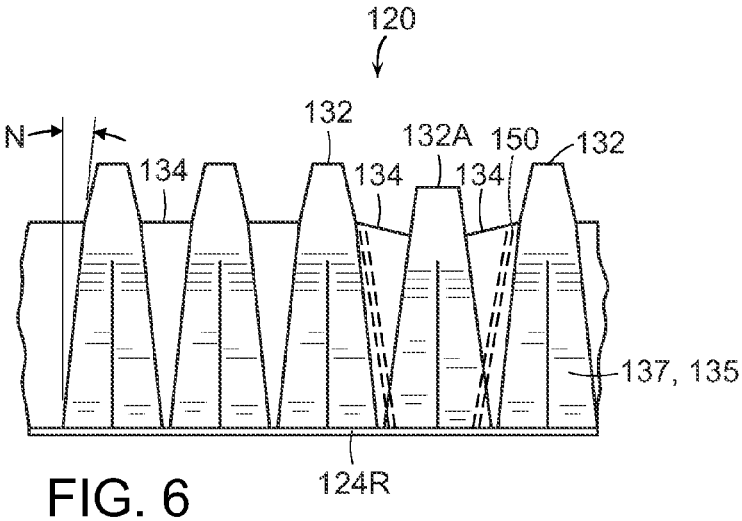
FIG. 6 is a side elevation view of a portion of the chamber of FIG. 1.

Opposing side webs 76 of a peak corrugation are typically canted or angled toward each other, as illustrated in FIG. 5A, to facilitate molding and nesting. See U.S. Pat. Nos. 5,511,903 and 7,473,053 for more information about the configurations of corrugations. The disclosures of said patents are hereby incorporated by reference. When some embodiments of chambers are viewed in side elevation, each peak corrugation and associated webs presents with an angle N, which may be seen as it is projected into a lengthwise vertical plane of the chamber, as shown in FIG. 6. Thus, the opposing sides (i.e., the webs) of a typical peak corrugation get closer to each other with increasing elevation. Angle N is will tend to be small when the number of corrugations per unit length of chambers is sought to be maximized, for strength. Angle N may be in the range 4 to 14 degrees, and in some embodiments it is about 6 degrees. See U.S. Pat. No. 7,306,399 for chamber configuration details which enable good nesting, the disclosure of which is hereby incorporated by reference.

Figure 5B:
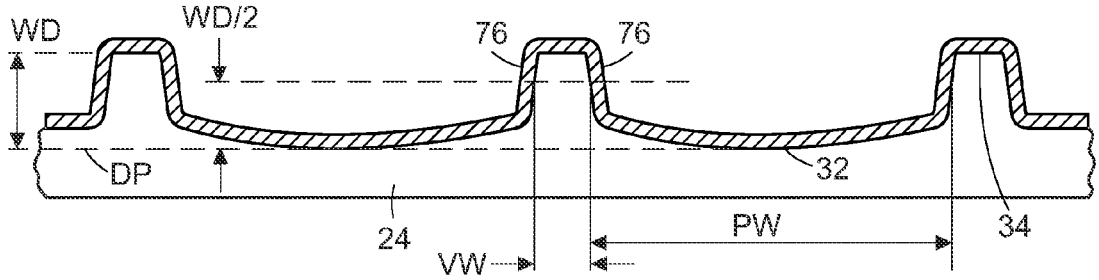
FIG. 5B is a view similar to that of FIG. 5A, showing a chamber having peak corrugations with curved sides.

Other shape corrugations usable on invention chambers may comprise those having more rounded valley bottoms and peak tops than shown in most of the Figures here. FIG. 5B shows a portion of a chamber having peak corrugations 32 which curve in the lengthwise direction of the chamber. Corrugations may have the shapes described in U.S. Pat. Publication No. 2007/0077122, the disclosure of which is hereby incorporated by reference.

An exemplary chamber 20 has 9 equal size peak corrugations separated by 8 equal size valley corrugations. With reference to FIG. 5A and FIG. 1, in chamber 20, the center to center spacing, or pitch P, of the peak corrugations is about 4.8 inches. Of course the pitch of the valley corrugations is the same.

Some embodiments of chambers of the present invention have special and advantageous relationships with respect to the widths of the peak and valley corrugations. With reference to FIG. 5B, the dimensions of width PW of a peak corrugation and width VW of a valley corrugation, as they are used here to define the claimed invention, are their nominal dimensions. The width dimensions may be measured as follows:

First, widths are measured parallel to the chamber length, in a horizontal plane.

Second, widths are measured at the midpoints of such webs. With reference to FIG. 5B, those locations are at distance WD/2 from the outer surface of the peak corrugation 32, where WD is the horizontal plane distance to the outer surface of a valley from a line DP which is parallel to the length of the chamber and in contact with the outer surface of an adjacent peak. Alternatively and simply stated, WD is the depth of corrugation.

Third, measurements are made at horizontal planes which are at two different elevations:

(a) They are made in a plane which is substantially at the elevation of the base flanges. That is, the plane of measurement is just slightly above the upper surface of the base flange, sufficient to avoid being influenced by fillets associated with the intersection of corrugation webs with the base flanges. This is called the base measurement.

(b) They are made in a plane which is half way up the sidewall. That is, with reference to FIG. 7, the plane of measurement is at an elevation SH/2, where SH is the total vertical height of the perforated portion sidewall 28. This measurement at elevation SH/2 is called the half height measurement. Dimension SH extends upwardly from the top surface of a base flange 24, to the top of inner surface of the uppermost slot-defining louver, when there are slots. If the chamber does not have slots, SH will extend to the top of the uppermost perforation or the uppermost portion of other sidewall feature which provides leaching area during use.

Referring again to the exemplary chambers 20, 120, 220, there are 9 peaks and 8 valleys along the nominal 48 inch length of the chamber. In chambers 20 and 120, at the base elevation, the peaks are about 4.1 inches wide and the valleys are about 0.7 inches wide. At the half-height elevation, the peaks are about 3.7 inches wide and the valleys are about 1.2 inches wide. Exemplary chamber 220 has base elevation peaks that are slightly wider and valleys that are slightly narrower; and the ratio is 6.2 to 1. At half-height chamber 220 has peaks about 3.6 inches wide and valleys about 1.3 inches wide; and the ratio is 2.8 to 1.

Table 2 shows rounded-off ratios of peak corrugation width to valley corrugation width at two elevations for exemplary chambers of the present invention. As shown in Table 2, the ratio for chambers 20 and 120 are nominally 5.9 to 1 at the base elevation and 3.2 to 1 at the half-height elevation.

TABLE 2

Ratio of Peak Corrugation Width to Valley Corrugation Width

| Chamber Configuration | Ratio at Base Flange | Ratio at Sidewall Half-Height |
|---|---|---|
| Invention | | |
| 20 | 5.9:1 | 3.2:1 |
| 120 | 5.9:1 | 3.2:1 |
| 220 | 6.2:1 | 2.8:1 |
| Prior Art | | |
| DS | 1.5:1 | 0.9:1 |
| DSW | 1.5:1 | 0.8:1 |
| DHC | 1.7:1 | 0.8:1 |
| DEQ2 | 1.2:1 | 0.9:1 |
| DEQ3 | 2:1 | 0.9:1 |
| B15 | 2:1 | 1.5:1 |
| SHC | 1:1 | 0.9:1 |

In embodiments of the invention, the rounded-off peak to valley ratio of a chamber at the base elevation is significantly greater than about 2 to 1; alternately, greater than about 2.5 to 1; alternately, greater than about 3 to 1; alternately, greater than about 5 to 1; alternately, in the range between 2.5 to 1 and 6 to 1; or more than 6 to 1. Such chambers may also have ratios at half-height elevation which are in the range of the prior art. Preferably, the sense of the width relationship at the base elevation is also present at the half-height elevation; and, when that is so, the peak to valley ratio is greater than 1.5 to 1; alternately greater than 2 to 1; alternately greater than 3 to 1; alternately, in the range of 1 to 1 and 3.2 to 1.

Table 2 also shows some comparable ratios for some prior art chambers. Those which bear "D" prefix are chambers of the type referred to in the Background, heretofore sold by Infiltrator Systems, Inc. They have 7 peaks and 6 valleys.

An arch shape cross section chamber of the present invention having peak corrugation to width corrugation ratios which are significantly greater than heretofore known, provides surprising advantages over prior art chambers. First, the number of corrugations per unit length, and thus the wall strength can be increased while still providing sidewall area which can be efficiently used for slots or other perforations. Second, the storage volume is increased. Third, the leaching area at the base of the chamber is increased. And, when only the peak corrugations have perforations: Fourth, the amount of plastic needed to provide a given sidewall leaching area is reduced. Fifth, injection molding tooling is simplified insofar as slot-defining slides are concerned. The following paragraphs elaborate on these aspects.

If the corrugations are nominally equal in width, or less than 2 times different in width, and the number of corrugations is increased, the sidewall region on each peak or valley which can have slots is made small. When that happens, the structure weight for a given amount of slots is increased as elaborated upon below.

There is more space vertically under a peak corrugation than under a valley corrugation of the same width. Thus, the interior volume, useful for storage of water, is also greater. So, the invention chamber has significantly more storage volume than a comparable prior art chamber having the same profile and width.

The invention chamber provides a flange design that enables increased bottom leaching area, compared to a prior art chamber. This can be appreciated from the fragment of chamber base shown in FIG. 5A. Note that portion 82 of the base flange—which closes the bottom of a valley, is made small. At the same time, note how the open area 84, which lies within the concavity of the lowermost end of a peak 32, is made large. Along the lengths of both of the opposing side flanges there is thus a reduction in the area of soil which is necessarily masked by flange portions closing the lower ends of valleys, and a consequent increase in the leaching area of the chamber.

In exemplary chamber 20, there are only perforations (slots) in the peaks. This reduces the amount of plastic in a chamber for a given sidewall leaching area, compared to a chamber having slots in both the peaks and valleys. This can be understood by reference to the simplified views of FIG. 7 and FIG. 8. The essential thickness t of the chamber sidewall 26 at a peak 32 where there are slots is about 0.150 inches, which compares with the chamber's basic wall thickness of 0.070 inch. Among the reasons for the increased thickness is that slots weaken the sidewall, and louvers which define slots ought to have thickness dimensions suited to inhibiting inflow of surrounding soil. There is a thickened area 78, which frames a slotted region, for strength and feeding during molding. See FIG. 7. When the number of locations where there are slots is reduced, the total length of "framing" on a chamber is reduced. When there are no slots in a valley the valley sidewall can have the basic wall thickness, 0.070 inch.

Tooling is simplified and cost reduced in that there are less locations requiring movable parts of the die (commonly referred to as slides).

In carrying out this aspect of the invention, a chamber having peak and valley combinations meeting the invention criteria may also have other corrugations. For example, there may be a narrow unperforated peak at each end of the chamber body. For example, there could be a wider valley at the center of the chamber.

Exemplary chambers have slots or other perforations only on the peak corrugations. In other embodiments of the invention, the valleys may have slots or other perforations, notwithstanding some of the advantages which have been referred to may be given up. As an example, when the ratio of peak widths to valley widths is in the lower end of the ranges stated above, the valleys may have slots. As an example, valleys may have perforations at elevations which are high above base flange, where the valleys widen.

Figure 7:
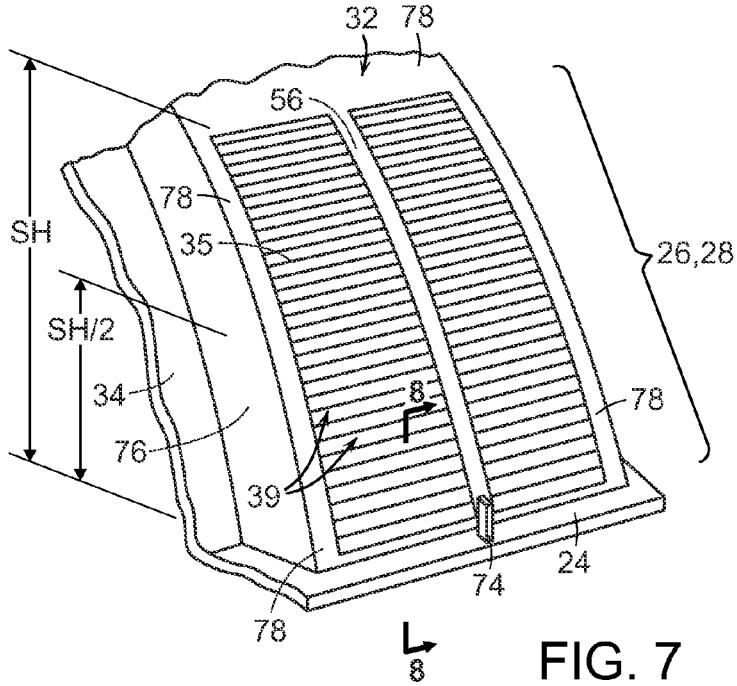
FIG. 7 is an oblique view of a fragment of the chamber of FIG. 1 showing the detail of a sidewall.
Figure 8:
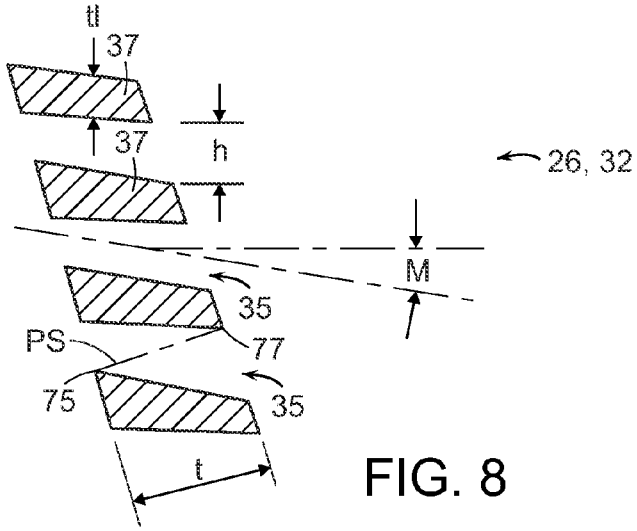
FIG. 8 is a vertical cross section through the portion of sidewall shown in FIG. 7.

Sidewalls may comprise a plurality of vertically and horizontally spaced apart slots as shown in the various embodiments here. FIG. 7 and FIG. 8 are simplified views of a slotted portion 26 of a sidewall 28 of a chamber like chamber 20. The portion 26 has a multiplicity of vertically spaced apart horizontal slots 35 defined by horizontal louvers 37. A center strut 56 makes the slots into horizontally spaced apart pairs and provides both strength and a plastic flow channel during injection molding. Alternately, none or more vertical struts may be used.

In an exemplary chamber, a slotted portion 26 of sidewall 28 may have a basic wall thickness t of about 0.150 inch. The slots, which are spaced apart about 0.13 to 0.15 inches on center, have a basic axis M which is sloped downwardly from the horizontal, for instance at an 8 degree angle. See FIG. 8. Each slot may have an opening height h of about 0.09 inches. In other embodiments of the invention, the slots and the sidewalls may be configured in accord with U.S. Pat. No. 7,465,122 of Brochu et al., the disclosure of which is hereby incorporated by reference. As mentioned, in the chamber lengthwise direction the peak portions of the sidewall may have little or no curve, as illustrated in FIG. 5A, or the sidewall may curve substantially in the lengthwise direction, as shown in FIG. 5B and Patent Publication No. 2007/0077122.

Figure 19:
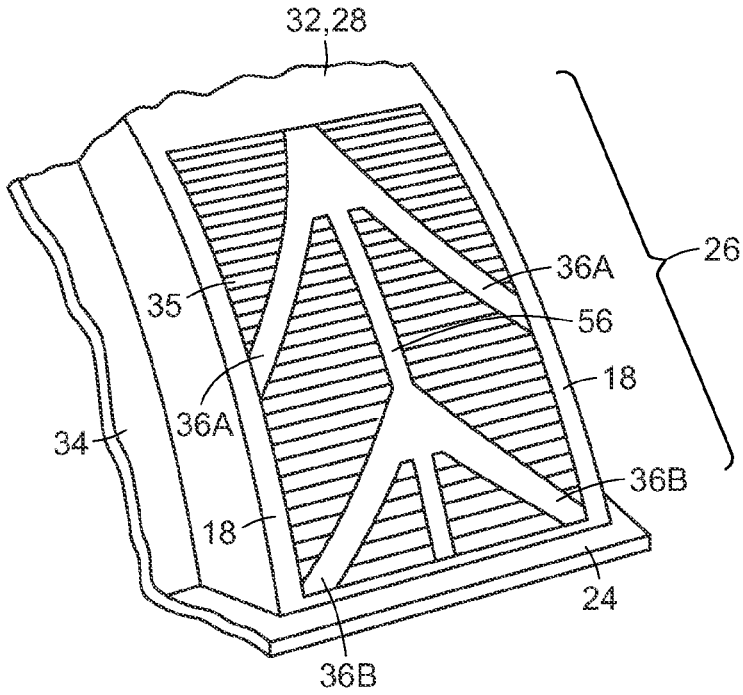
FIG. 19 is like FIG. 7, and shows a portion of a slot-perforated sidewall which has strengthening struts.

FIG. 19 shows a portion of perforated sidewall which has two pairs of diagonally running struts, namely struts 36B and struts 36A. The struts are molded into the sidewall and interconnect the louvers. As shown in FIG. 19, a strut 36A, 36B, runs from the solid portion 78 near the edge of the corrugation, to the center strut 56. Each horizontally-related strut pair forms a vee-pattern. The struts strengthen the perforated sidewall, distributing load horizontally and vertically. Other configurations of struts may be used. For example, see U.S. Pat. No. 5,511,903 of Nichols et al. and the disclosure relating to FIG. 10, which is hereby incorporated by reference.

Generally, the sidewall perforations may have other shapes than slots. For example, the perforations may be simply round or other-shape holes, and the chamber may be covered by geotextile when installed, to prevent soil entry. Alternative chambers within the scope of the invention may lack any sidewall perforations, when it is acceptable to have a chamber with only bottom leaching area. In use, water out-flow (or inflow, when the chamber is used for draining) will take place though the open bottom of the chamber.

With the combination of sidewall features and pillars, a chamber made of un-reinforced polyolefin thermoplastic of the types which characterize most commercial chambers, may have a basic wall thickness of about 0.070 inch (excluding regions where there are slots), and still have property sets heretofore unachieved, as mentioned above. As mentioned, pillars of the present invention may be used in chambers which do not have the advantageous peak and corrugation combinations, and chambers having the unique peak and corrugation sidewall combinations may lack pillars.

Chamber Family with Same-Size Connectors

Chambers 20, 120, 220 are configured to connect with other like chambers, to form a string of chambers in a leaching trench by means of the illustrated end connectors. In chamber 20 connectors 40, 42 are integrally attached to end walls 22P, 22D. Each connector has a roughly congruent dome shape portion, so that connector 42 can overlap connector 40 of a like chamber; and, swivel adjustment of the angle between the chambers is possible. The dome shape connectors 40, 42 have a generally arch shape cross section with curved tops and mating male pin 44 and female pin 46. Pins have also been referred to as posts. The dome connectors may have features like those described in U.S. Pat. Nos. 7,189,027, 7,351,006 and 7,419,332, the disclosures of which are hereby incorporated by reference. In alternative chamber embodiments, the connectors overlap-underlap but do not enable pivoting in the horizontal plane.

In some embodiments of the present invention, the chamber has an end wall and associated connector. In other embodiments, the chamber has an end wall without connector. With respect to the former, chamber 20 has an end wall 22 which partially closes the end of the chamber. End wall 22 has an associated base flange portion (that portion which forms the C-shapes which have been mentioned above). End walls 22P, 22D have respective openings 48P, 48D which enable water to flow respectively into the interior of the respective associated dome connectors 40, 42. Dome connector 40 has an opening 62P and dome connector 42 has an opening 62D. Thus the openings 62 enable water to flow into or out of the chamber via the connectors, to other interconnected chambers.

An end dome of a chamber 20 may be alternatively connected to a coupling of the type described in U.S. Pat. No. 7,351,006, or to a faceted end cap of the type described in U.S. Pat. No. 7,008,138. An end plate which is essentially flat, not shown, may alternately be used to close off an opening 62 at the end of a chamber; and, as desired, a hole may be cut in such plate for a water pipe.

In an alternate embodiment, a chamber does not have a connector. As an example, in chamber 320, shown in FIG. 12, the body of the chamber is closed off by wall 322 which has no openings. The opposing side base flanges meet and are continuous at the centerline in this embodiment.

Figure 12:
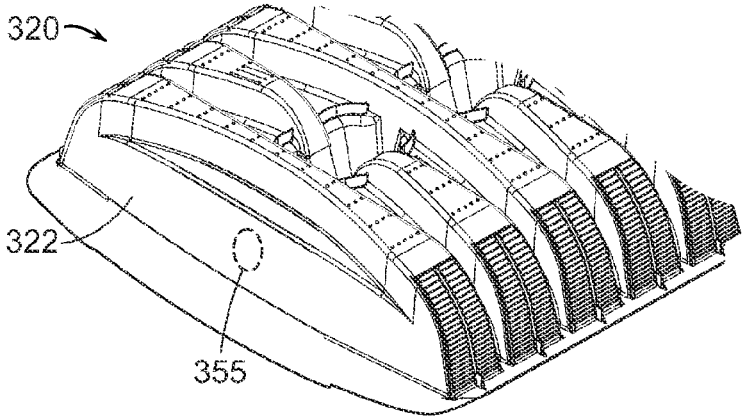
FIG. 12 is an oblique view of a portion of a chamber which is similar to the chamber of FIG. 2B, but for having a closed end wall and no connector.

As shown in FIG. 12 by means of dashed circle 355 in the end wall 322, a hole may be cut in the wall for a pipe which can flow water in or out of the chamber. Alternately, a port may cut into the top of the chamber. Chamber 20 has an incised or embossed circle 80 on a peak corrugation, where a hole may be cut for such purpose. See FIG. 1.

The invention chambers compare to chambers in the prior art where the end of the chamber either had a large arch shape opening with latches or the like, or where there was a dome shape connector, the height of which approximated the height of the chamber. In the invention, chambers are members of a family and have heights H in the range 8-14 inches. As shown in FIG. 3A, H extends from the base plane to the top of a peak corrugation, but does not include any male pin 44 or female pin 46 or like accessory feature. Widths of chambers in a family may vary from chamber to chamber.

In an embodiment of the invention, different height chambers have a connector which is the same size. That is, the connector on each chamber has a height which corresponds with the height of the smallest chamber of the family (8 inches in the example here). Alternatively, the connector has a height which is larger than the height of the smallest chamber. Thus, chambers of different heights can be used to make a string of chambers. And, the same closure or coupler can be used for any chamber regardless of chamber size. That simplifies inventory of parts for an installer or distributor. This aspect of the invention may be applied to chambers of the prior art, for example, to chambers which are described in the patents which are incorporated by reference here.

An end wall 22 may have strengthening features, such as contoured portions which increase section modulus, to resist deformation as a result of soil forces when buried. This is particularly desirable when a chamber has a connector which is substantially smaller in height than the height of the chamber, as just described for an interconnectable family of chambers. In such instance, the structural support which a connector inherently provides to an end wall is lessened. As shown in FIG. 9, end wall 122P has triangle shape buttresses 164 on either side of the dome connector 140 and triangle buttress 166 just above the dome. Other shape buttresses may be used. The end wall 122P also has a curved arch step 168 for strength. A like feature is present on end wall 22P of chamber 20 in FIG. 1. The end walls strengthen the end of the chamber and, when present, work in cooperation with pillars which strengthen the chamber span between the ends. Features in accord with those described for the end wall, and further including small surface ribs and the like, may be used elsewhere in the chamber to provide local strength when, in the course of product design and use, weak areas are found which need strengthening.

Figure 16:
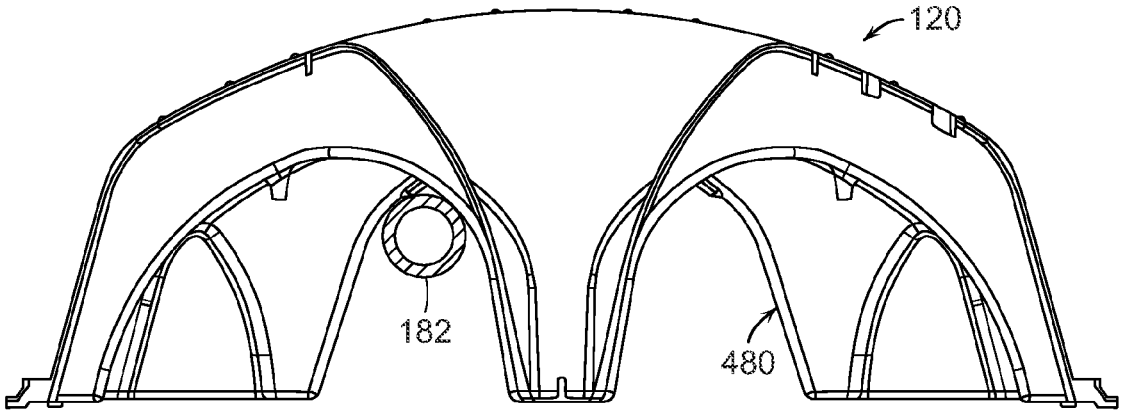
FIG. 16 is a projected vertical plane cross section of the chamber of FIG. 9, showing a suspended dosing pipe.

The openings 62 of the connectors 40, 42, referred to above, are shaped to mate and align with openings 48 in the end walls. Thus a dosing pipe may be suspended from the top of the chamber, to run lengthwise through a string of interconnected chambers. In the prior art, dosing pipes have been typically run down the center of the chamber. FIG. 16 shows dosing pipe 182 suspended within the interior of chamber 120, which has a center pillar 152. The dosing pipe is offset from the chamber center line. A dosing pipe can be suspended as shown by one or more hangers, particularly hangers which are fastened to the top of the chamber, in particular by means of holes in an underlying end dome, for example dome 40 in the chamber 20 of FIG. 1. Hangers in the dome region may be specially located not to interfere with swivel motion, as taught by U.S. Pat. No. 7,306,400, the disclosure of which is incorporated by reference. A dosing pipe may also be hung from the top of the chamber at other points along the chamber length, or it alternatively may be supported by pedestals.

The interior of an invention chamber is desirably free of internal strengthening ribs, although they alternatively may be present. Among other reasons, such ribs may increase stacking height. The interior has lengthwise parallel skirts 38, for intercepting dosing pipe water which runs downward after being sprayed against the interior of the top of the chamber. See FIG. 13.

A chamber of the invention may be made by injection molding of a thermoplastic such as polypropylene or polyethylene. The chamber may alternatively be made of other thermoplastic or thermoset materials including fiberglass containing materials. A thermoplastic chamber may alternatively be formed by thermoforming, welding, or other commercially feasible processes or combinations of such. A typical polyethylene of polypropylene thermoplastic may have a density in the range of 0.032-0.036 lb per cu inch. Chambers may alternately be made of non-plastic materials.

As mentioned above, the inventions are particularly useful for low profile chambers; in particular, useful embodiments of the present invention have a height which is less than 11 inches and a width which is greater than 30 inches. Based on the effective length of the chamber, the bearing area of a chamber is equal to or greater than 20 square inches per foot; the open base area is greater than 2.2 square feet per foot; and, the volume is greater than 0.9 cubic feet per lineal foot.

While chambers of the present invention are best made by injection molding, pillars may be formed separately and welded to or mechanically attached to the chamber, as mentioned above in connection with FIG. 3B. As mentioned in the Background, chambers of the present invention may be used for other purposes than receiving wastewater; and, stormwater chambers or chambers used for draining may embody the invention features which have been described.

A chamber of the present invention is made and used in the following typical way. As described above, the chambers are molded of plastic and nested to form a stack which is placed on a pallet. The pallet is transported by truck and or other means to the point of use. One or more long trenches are excavated in soil, with dimensions suited to receive a multiplicity of interconnected chambers. Sometimes gravel or crushed rock is placed in the trench. Workers remove chambers from the top of the stack or otherwise separate them and place them in the trench while mating them at the chamber end connectors, to form one or more strings of chambers. The chamber strings are connected by a pipe running from a source of wastewater, typically a distribution box connected to the outlet of a septic tank. Sometimes gravel or crushed rock is placed on and next to the chamber, within the trench. Sometimes geotextile filter fabric is placed over the tops and sidewalls of the chambers or on top of any crushed rock or gravel. Soil is backfilled into the excavation. Wastewater is flowed into the interiors of the chambers and it migrates into the soil through the bottom and sidewalls of the chambers, where it is biologically acted on by microorganisms, to thereby remove harmful pollutants.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory.

Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. In a molded plastic chamber for collecting, receiving, detaining, and/or dispersing water when buried, wherein the chamber comprises an arched chamber wall connected to side base flanges at opposing sides of the chamber wall, which side base flanges are substantially coplanar in a base plane, the improvement comprising:

at least one hollow pillar integral with the chamber wall, wherein the pillar tapers downwardly and inwardly from an opening in the chamber wall to a pillar base which is substantially coplanar with the base plane.

2. The chamber of claim 1 wherein the chamber height is less than 11 inches and wherein the chamber width is greater than 30 inches.

3. The chamber of claim 2 wherein the chamber is shaped (a) to be nestable on top of a like chamber and (b) to be removable from the like chamber below by lifting one side base flange and rotating the chamber about the opposing side base flange.

4. The chamber of claim 1 wherein at least a portion of the chamber wall comprises alternating peak corrugations and valley corrugations, and wherein at least one peak corrugation or valley corrugation continues in at least a portion of at least one pillar.

5. The chamber of claim 1 wherein the sum of the areas in the base plane of all pillar bases is between 4 and 15 percent of the sum of the area in the base plane of the side base flanges and all pillar bases.

6. The chamber of claim 1 wherein the chamber meets the testing requirements of an H-10 load rating in Section 6 Testing Requirements of the International Association of Plumbing and Mechanical Officials, Material and Property Standard for Plastic Leaching Chambers IAPMO PS 63-2005.

7. The chamber of claim 1, wherein the length of said chamber wall opening is more than half the length of the chamber.

8. A molded plastic chamber for collecting, receiving, detaining, or dispersing water when buried, comprising:

(a) a first end and a second end separated along a lengthwise direction;

(b) a first side and a second side separated along a widthwise direction perpendicular to the lengthwise direction;

(c) a first side base flange, at least part of which extends lengthwise along part of the first side, and a second side base flange, at least part of which extends lengthwise along part of the second side, which side base flanges are separated from each other in the widthwise direction and are substantially coplanar with a base plane;

(d) a chamber wall connecting the first side base flange to the second side base flange and forming a cavity below the chamber wall; and, (e) one or more pillars, each pillar comprising a pillar wall which (i) is integrally connected with the chamber wall at the perimeter of a hole in the chamber wall;

(ii) has an inward taper from the chamber wall down to a pillar base, which pillar base comprises a portion which is substantially co-planar with the base plane; and, (iii) surrounds a hollow space which is in communication with the space above the chamber.

9. The chamber of claim 8 wherein the chamber height is less than 11 inches and the chamber width is greater than 30 inches.

10. The chamber of claim 8 wherein the chamber wall and pillars are shaped to enable the chamber (a) to be nestable on top of a like chamber and (b) to be removable from the like chamber below by lifting one side base flange and rotating the chamber about the opposing side base flange.

11. The chamber of claim 8 wherein the bearing footprint area of the chamber divided by the effective length of the chamber equals or exceeds 20 square inches per lineal foot, wherein the open base area divided by the effective length exceeds 2.2 square feet per lineal foot and wherein the chamber volume divided by the effective length exceeds 0.9 cubic feet per lineal foot.

12. The chamber of claim 8 wherein the pillar base is longer in the lengthwise direction than in the widthwise direction and wherein the pillar base extends along the length of the chamber to proximity of said first end and second end.

13. The chamber of claim 8 wherein at least part of the chamber wall has peak corrugations and valley corrugations and wherein the hole in the chamber wall is centered on a valley corrugation.

14. A plastic leaching chamber having an arch shape cross section, for receiving and dispersing water when buried beneath the surface of soil, which comprises:

opposing side base flanges, spaced apart on either side of the lengthwise vertical centerplane of the chamber, for providing bearing area to support the chamber during use, wherein the space between the opposing side base flanges provides for leaching area beneath the chamber during use;

opposing sidewalls, each sidewall running upwardly and inwardly from a base flange and having a plurality of perforations;

a top, connecting the upper ends of the sidewalls; wherein the sidewalls and top form an arch shape wall which defines a concave chamber interior, said arch shape wall having alternating peak corrugations and valley corrugations running transverse to the length of the chamber; and, one or more hollow pillars spaced apart inwardly from the sidewalls and from the lengthwise ends of said concave chamber interior, each pillar extending downwardly into the chamber interior from the top of the chamber, and each pillar comprising a pillar base having an elevation which is proximate the elevation of the plane of said base flanges.

15. The chamber of claim 14 wherein each of said one or more pillars has an open upper end and extends downwardly from an opening at the top of the chamber; and, wherein each pillar tapers inwardly in the downward direction.

16. The chamber of claim 15 wherein each pillar is shaped so that the chamber is removable from the top of a stack of nested identical chambers by upwardly lifting one base flange, to thereby rotate the chamber in a plane which is transverse to said lengthwise center plane.

17. The chamber of claim 14 wherein the total footprint bearing area of said one or more pillars is between 4 and 15 percent of the total bearing area of the chamber.

18. The chamber of claim 14 wherein the chamber meets the testing requirements for an H-10 Load Rating of the International Association of Plumbing and Mechanical Officials, Material and Property Standard for Plastic Leaching Chambers IAPMO PS 63-2005.

19. The chamber of claim 14 wherein each pillar has a vertically running corrugation or sponson.

20. The chamber of claim 15 wherein the chamber wall and pillar are made of a single piece of injection molded plastic; wherein at least one pillar base has one or more openings lying in a plane parallel to said base plane; wherein said perforations comprise slots spaced apart horizontally and vertically on a plurality of peak corrugations; and wherein the flanges have C-shape configurations in said base plane; further comprising a dome shape connector at each lengthwise end of the chamber, for forming underlapping-overlapping connections with like chambers.

* * * * *